US009887481B2

(12) United States Patent
Inaka et al.

(10) Patent No.: US 9,887,481 B2
(45) Date of Patent: Feb. 6, 2018

(54) TERMINAL, CONNECTOR, AND ELECTRICAL CONNECTION APPARATUS

(71) Applicant: J.S.T. Mfg. Co., Ltd., Osaka-shi (JP)

(72) Inventors: Kentaro Inaka, Osaka (JP); Katsuyuki Masaki, Osaka (JP)

(73) Assignee: J.S.T. MFG. CO., LTD., Osaka (JP)

( * ) Notice: Subject to any disclaimer, the term of this patent is extended or adjusted under 35 U.S.C. 154(b) by 0 days.

(21) Appl. No.: 15/479,601

(22) Filed: Apr. 5, 2017

(65) Prior Publication Data

US 2017/0294730 A1 Oct. 12, 2017

(30) Foreign Application Priority Data

Apr. 11, 2016 (JP) ..... 2016-79086

(51) Int. Cl.

| | |
|---|---|
| ***H01R 13/10*** | (2006.01) |
| ***H01R 13/40*** | (2006.01) |
| ***H01R 13/426*** | (2006.01) |
| ***H01R 13/627*** | (2006.01) |
| ***H01R 13/17*** | (2006.01) |
| ***H01R 13/422*** | (2006.01) |
| ***H01R 12/71*** | (2011.01) |
| ***H01R 4/18*** | (2006.01) |

(52) U.S. Cl.

CPC ..... *H01R 13/426* (2013.01); *H01R 4/185* (2013.01); *H01R 12/716* (2013.01); *H01R 13/17* (2013.01); *H01R 13/422* (2013.01); *H01R 13/6273* (2013.01)

(58) Field of Classification Search

CPC .. H01R 12/716; H01R 13/113; H01R 13/428; H01R 13/187; H01R 13/6272; H01R 13/4223; H01R 4/185

See application file for complete search history.

(56) References Cited

U.S. PATENT DOCUMENTS 6,159,047 A * 12/2000 Tanaka ..... H01R 13/4364 439/595
7,204,728 B2 * 4/2007 Noro ..... H01R 13/115 439/752.5
7,232,339 B1 * 6/2007 Wilson ..... H01R 13/11 439/595

(Continued)

FOREIGN PATENT DOCUMENTS

JP 2000-353561 A 12/2000

*Primary Examiner* — Xuong Chung Trans

(74) *Attorney, Agent, or Firm* — Kratz, Quintos & Hanson, LLP

(57) ABSTRACT

An abutting portion is provided as a portion of an edge portion of an upper wall portion, and abuts against an edge portion of a first side wall portion when the upper wall portion bends toward the inside of a tubular wall portion. The projection portion projects from the upper wall portion, and restricts insertion of the tubular wall portion toward the back of the housing by abutting against the housing when the tubular wall portion is inserted into the housing in an orientation different from a predetermined insertion orientation. The engaging portion is configured to be able to engage with an engaged portion provided on an inner side of the housing. The engaging portion is provided on the tubular wall portion at a position that shifted from or separated from the projection portion in the longitudinal direction of the tubular wall portion.

8 Claims, 28 Drawing Sheets

(56) References Cited

U.S. PATENT DOCUMENTS 7,311,561 B2 * 12/2007 Anbo ..... H01R 4/185
439/752.5
9,368,896 B2 * 6/2016 Suzuki ..... H01R 13/4223

* cited by examiner

TERMINAL, CONNECTOR, AND ELECTRICAL CONNECTION APPARATUS

CROSS-REFERENCE TO RELATED APPLICATION

This application claims priority to Japanese Patent Application No. 2016-079086. The entire disclosure of Japanese Patent Application No. 2016-079086 is hereby incorporated herein by reference.

BACKGROUND OF THE INVENTION

1. Field of the Invention

The present invention relates to a terminal for a connector that is used in a state of being inserted into a housing of the connector, and also relates to a connector that includes this terminal, and an electrical connection apparatus that includes this connector.

2. Description of Related Art

The terminal disclosed in JP 2000-353561A is known as an example of a terminal for a connector that is used in a state of being inserted into a housing of the connector. The terminal disclosed in JP 2000-353561A is configured as a female contact F that has a tubular (tube-like) portion 1 into which a male contact M is inserted, and the tubular portion 1 is formed by a bottom wall 2, side walls (3, 3) that rise up from two ends of the bottom wall 2 in the width direction, an outer ceiling wall 4, and an inner ceiling wall 5. Note that the outer ceiling wall and the inner ceiling wall each extend from the ceiling edge of the corresponding side wall toward the ceiling edge of the opposing side wall, and are provided in a manner of overlapping each other.

As described in paragraph 0017 and shown in FIGS. 1 and 2 of JP 2000-353561A, a portion of the bottom wall 2 of the female contact F is cut and bent outward so as to serve as a rib 10. In this configuration, when the female contact F is to be inserted into the housing chamber of a female housing FH, the rib 10 is fitted into a guiding groove that has been cut into the female housing FH, thus enabling the female contact F to be inserted into the housing chamber of the female housing FH. For this reason, if the tubular portion 1 of the female contact F is inserted into the housing chamber of the female housing FH in an orientation different from a predetermined insertion orientation, the rib 10 abuts against the female housing FH, thus restricting the tubular portion 1 from being inserted toward the back of the female housing FH. Accordingly, erroneous attachment of the female contact F to the female housing FH is prevented.

Also, the female contact F is configured such that when the female contact F is inserted into the housing chamber of the female housing FH, a housing lance is fitted into the hole formed by cutting and bending the rib 10. Accordingly, the edge portion of this hole is configured to be able to engage with the housing lance of the female housing FH when the female contact F is inserted into the housing chamber of the female housing FH. Due to this hole provided in the female contact F engaging with the female housing FH, the female contact F that has been inserted into the female housing FH is prevented from coming out of the female housing FH.

SUMMARY OF THE INVENTION

In the female contact F disclosed in JP 2000-353561A, the rib 10 for preventing erroneous attachment of the female contact F to the female housing FH is formed by cutting a portion of the bottom wall 2 and bending it outward. Also, in the female contact F, the portion that engages with the female housing FH when the female contact F is inserted into the female housing FH in order to prevent the female contact F from coming out of and being withdrawn from the female housing FH is provided as the edge portion of the hole formed by cutting and bending the rib 10.

According to the above configuration of the female contact F, the erroneous attachment prevention portion, which is the portion for preventing erroneous attachment of the female contact F to the female housing FH, and the withdrawal prevention portion, which is the portion for preventing the female contact F from coming out of and being withdrawn from the female housing FH, are provided adjacent to each other. For this reason, in the female contact F, the position of the erroneous attachment prevention portion and the position of the withdrawal prevention portion are constrained by the positions of one another. Accordingly it is desirable to be able to realize a terminal structure that can suppress the case in which the position of the erroneous attachment prevention portion and the position of the withdrawal prevention portion are constrained by the positions of one another.

Also, when realizing the aforementioned terminal structure, it is desirable to be able to use a simple structure to ensure appropriate operation of the erroneous attachment prevention portion when the erroneous attachment prevention portion of the terminal abuts against the housing of the connector due to the terminal being inserted into the housing in an orientation different from a predetermined insertion orientation.

In light of the above-described circumstances, an object of the present invention is to provide a terminal that can suppress the case in which the position of an erroneous attachment prevention portion, which is for preventing erroneous attachment of the terminal to a housing, and the position of a withdrawal prevention portion, which is for preventing the terminal from being withdrawn from the housing, are constrained by the positions of one another, and that enables realizing a simple structure for ensuring appropriate operation of the erroneous attachment prevention portion. Another object is to provide a connector that includes this terminal. A further object is to provide an electrical connection apparatus that includes this connector.

(1) A terminal according to one aspect of the present invention for achieving the above objects is a terminal for a connector that is used in a state of being inserted into a housing of the connector, the terminal including: a tubular (tube-like) wall portion having a first side wall portion, a bottom wall portion that is integrated with the first side wall portion, a second side wall portion that is integrated with the bottom wall portion, and an upper wall portion that is integrated with the second side wall portion; an abutting portion that is provided as a portion of an edge portion of the upper wall portion, and is configured to abut against an edge portion of the first side wall portion when the upper wall portion bends toward an inside of the tubular wall portion; a projection portion that protrudes from the upper wall portion in the shape of a protrusion or a projection, and that restricts insertion of the tubular wall portion toward a back of the housing by abutting against the housing when the tubular wall portion is inserted into the housing in an orientation different from a predetermined insertion orientation; and an engaging portion that is provided on the tubular wall portion and is configured to be able to engage with an engaged portion provided on an inner side of the housing when the tubular wall portion is inserted into the housing in the predetermined insertion orientation. Also, the engaging portion and the engaged portion are configured to be able to engage with each other by one of the engaging portion and the engaged portion abutting against the other one, elastically deforming, and then undergoing elastic recovery when the tubular wall portion is inserted into the housing in the predetermined insertion orientation, and the engaging portion is provided on the tubular wall portion at a position that is shifted from or separated from the projection portion in a longitudinal direction that is a direction in which the tubular wall portion extends in a tube shape.

In the terminal having the above configuration, when the tubular wall portion is inserted into the housing of the connector in an orientation different from the predetermined insertion orientation, the projection portion abuts against the housing 14, thus restricting insertion of the tubular wall portion toward the back of the housing. Accordingly, erroneous attachment of the terminal to the housing is prevented. In other words, in the terminal having the above configuration, the projection portion is provided as an erroneous attachment prevention portion for preventing erroneous attachment of the terminal to the housing.

Also, the terminal having the above configuration is provided with the engaging portion that can engage with the engaged portion inside the housing when the terminal is inserted into the housing in the predetermined insertion orientation. The engaging portion and the engaged portion can engage with each other by one of them abutting against the other one, elastically deforming, and then undergoing elastic recovery. Due to the above-described engagement of the engaging portion of the terminal to the housing, when the terminal is inserted into the housing, the terminal is prevented from coming out of and being withdrawn from the housing. In other words, in the terminal having the above configuration, the engaging portion is provided as a withdrawal prevention portion for preventing the terminal from being withdrawn from the housing.

Furthermore, in the terminal having the above configuration, the engaging portion is provided at a position on the tubular wall portion that is shifted from or separated from the projection portion in the longitudinal direction. For this reason, according to the terminal having the above configuration, the projection portion serving as the erroneous attachment prevention portion and the engaging portion serving as the withdrawal prevention portion are provided in a state of being shifted or separated and independent in the longitudinal direction of the tubular wall portion. Thus, according to the terminal having the above configuration, it is possible to suppress the case where the projection portion serving as the erroneous attachment prevention portion and the engaging portion serving as the withdrawal prevention portion are constrained by the positions of one another.

Also, according to the terminal having the above configuration the tubular wall portion is constituted by integrally providing the first side wall portion, the bottom wall portion, the second side wall portion, and the upper wall portion in the stated order, and thus is constituted with a simple structure. Furthermore, in the terminal having the above configuration, the projection portion serving as the erroneous attachment prevention portion is constituted with a simple structure of projecting from the upper wall portion in the shape of a protrusion or a projection. Also, according to the terminal having the above configuration, a portion of the edge portion of the upper wall portion is constituted as an abutting portion that abuts against the edge portion of the first side wall portion when the upper wall portion bends toward the inside of the tubular wall portion. For this reason, even in the case where the terminal is inserted into the housing in an orientation different from the predetermined insertion orientation, the projection portion abuts against the housing, and the upper wall portion provided with the projection portion bends toward the inside of the tubular wall portion, the abutting portion abuts against the edge portion of the first side wall portion, thus preventing the upper wall portion from collapsing into the interior of the tubular wall portion. Accordingly, the projection portion is maintained in a state of abutting against the housing, and appropriate operation of the projection portion serving as the erroneous attachment prevention portion is ensured. Also, according to the terminal having the above configuration, the structure for ensuring appropriate operation of the projection portion serving as the erroneous attachment prevention portion is realized by a simple structure including the tubular wall portion that has a simple structure, the projection portion that has a simple structure, and the abutting portion that has a simple structure, is provided as a portion of the edge portion of the upper wall portion, and abuts against the edge portion of the first side wall portion. Thus, according to the terminal having the above configuration, it is possible to use a simple structure to ensure appropriate operation of the erroneous attachment prevention portion.

As described above, according to the above configuration, it is possible to provide a terminal that can suppress the case in which the position of an erroneous attachment prevention portion, which is for preventing erroneous attachment of the terminal to the housing, and the position of a withdrawal prevention portion, which is for preventing the terminal from being withdrawn from the housing, are constrained by the positions of one another, and that enables realizing a simple structure for ensuring appropriate operation of the erroneous attachment prevention portion.

(2) The projection portion may be provided on the tubular wall portion at a position on a leading end side relative to the engaging portion in an insertion direction that is a direction in which the tubular wall portion is inserted into the housing in parallel with the longitudinal direction, and the engaging portion may be provided on the tubular wall portion at a position that is shifted from or separated from the projection portion in a direction opposite to the insertion direction.

According to this configuration, the projection portion is provided on the leading end side in the direction of insertion of the terminal into the housing. For this reason, when the terminal is inserted into the housing in an orientation different from the predetermined insertion orientation, the projection portion abuts against the edge portion of the opening of the terminal insertion hole, which is the hole of the housing into which the terminal is inserted, and most of the portion of the terminal other than the portion on the leading end side of the tubular wall portion is exposed from the housing. Accordingly, the erroneous attachment state in which the terminal has been inserted into the housing in an orientation different from the predetermined insertion orientation is shown more clearly. Therefore, the operator who is performing the operation of inserting the terminal into the housing can quickly and easily see and recognize that erroneous attachment has occurred.

Furthermore, according to the above configuration, the engaging portion is provided on the tubular wall portion at a position that is shifted from or separated from the projection portion in the direction opposite to the direction of insertion of the terminal into the housing. For this reason, the position of the engaging portion serving as the withdrawal prevention portion is set to a position that is shifted or separated to the side opposite to the leading end side of the terminal, thus suppressing the case where this position is constrained by the position of the projection portion provided on the leading end side of the terminal. Also, due to the position of the engaging portion being set to a position that is shifted from or separated from the leading end side of the terminal, the engaging portion can be provided in a portion that has higher rigidity in the tubular wall portion. Accordingly, an engaging portion having higher rigidity can be constituted easily.

(3) The projection portion may have a bent portion that is integrated with a portion of the edge portion of the upper wall portion and is provided as a portion that extends while bending relative to the upper wall portion, and a projecting end portion that is provided as a portion projecting and extending from the bent portion in a cantilevered manner.

According to this configuration, the projection portion is constituted with a simple structure including the bent portion that is integrated with a portion of the edge portion of the upper wall portion, and the projecting end portion that extends from the bent portion in a cantilevered manner. Accordingly, the projection portion can be realized with an even simpler structure.

(4) The terminal may further include: electrical contact portions that are provided inside the tubular wall portion; and a pair of contact spring portions that are respectively provided as a portion of the first side wall portion and a portion of the second side wall portion, and that are provided as plate spring-shaped portions that extend in a cantilevered manner, and the electrical contact portions may be respectively provided on leading end sides of the pair of contact spring portions that extend in a cantilevered manner.

According to this configuration, the pair of contact spring portions respectively provided with the electrical contact portions are constituted as a portion of the first side wall portion and a portion of the second side wall portion. For this reason, a portion of the first side wall portion and a portion of the second side wall portion can be caused to function as the pair of contact spring portions, and the pair of contact spring portions can be realized with a simple structure. Furthermore, the pair of contact spring portions, which are provided as plate spring-shaped portions that extend in a cantilevered manner, and are provided with the electrical contact portions on the leading end side, are constituted as a portion of the first side wall portion or the second side wall portion. According to this configuration, it is possible to easily set a long length for the arm length from the base portions of the plate springs, which extend in a cantilevered manner, to the electrical contact portions on the leading end side. Also, the pair of contact spring portions are provided in the first side wall portion and the second side wall portion, and are not provided on the upper wall portion, thus making it possible to suppress the case of influencing the strength of the upper wall portion, which is the portion on which the projection portion is provided.

(5) The contact spring portions may each be arranged inward in a width direction of the tubular wall portion relative to an edge portion of the upper wall portion.

According to this configuration, the contact spring portions, which are provided as portions of the first and second side wall portions respectively, are arranged inward of the edge portions of the upper wall portion in the width direction of the tubular wall portion. For this reason, even if the terminal comes into contact with an outside object, it is possible to effectively suppress the case where the outside object comes into contact with and applies external force to the contact spring portions and deforms or breaks the contact spring portions. In particular, when multiple terminals are conveyed in a collective manner, it is possible to effectively suppress the case where another terminal comes into contact with and applies external force to the contact spring portions and deforms or breaks the contact spring portions.

(6) A plurality of abutting portions may be provided, and the plurality of abutting portions may be provided on the upper wall portion at positions that are separated from each other in the longitudinal direction.

According to this configuration, multiple abutting portions are provided as portions of the edge portion of the upper wall portion. Furthermore, the abutting portions are provided at positions that are separated from each other in the longitudinal direction of the tubular wall portion. For this reason, even in the case where the terminal is inserted into the housing in an orientation different from the predetermined insertion orientation, the projection portion abuts against the housing, and the upper wall portion provided with the projection portion bends toward the inside of the tubular wall portion, the abutting portions that are separated from each other abut against the edge portion of the first side wall portion. This therefore more reliably prevents the upper wall portion from collapsing into the interior of the tubular wall portion. Also, the projection portion can be more reliably maintained in a state of abutting against the housing, and appropriate operation of the projection portion serving as the erroneous attachment prevention portion can be more reliably ensured.

(7) A connector according to one aspect of the present invention for achieving the above objects is a connector that includes a plurality of the terminals according to any of the above-described aspects of the present invention, and further includes a housing configured to hold the plurality of terminals, wherein a plurality of the engaged portions are provided on an inner side of the housing, and the engaged portions are configured to be capable of being engaged with the engaging portions of the terminals.

According to this configuration, it is possible to achieve effects similar to those of the terminal according to the above-described aspect of the present invention. In other words, according to this configuration, it is possible to provide the connector that includes the terminal that can suppress the case in which the positions of the erroneous attachment prevention portion and the withdrawal prevention portion are constrained by the positions of one another, and that realizes a simple structure for ensuring appropriate operation of the erroneous attachment prevention portion. Also, according to the above configuration, in the housing of the connector as well, the position of the engaged portion that is engaged to the engaging portion of the terminal and the position of the portion that corresponds to the projection portion of the terminal can be set to independent positions. For this reason, in the housing of the connector as well, it is possible to suppress the case where the position of the engaged portion that is engaged to the engaging portion of the terminal and the position of the portion that corresponds to the projection portion of the terminal are constrained by the positions of one another. Furthermore, this makes it possible to improve the degree of freedom in the design of the connector.

(8) An electrical connection apparatus according to one aspect of the present invention for achieving the above objects is an electrical connection apparatus that includes the connector according to the above-described aspect of the present invention, and further includes a second connector capable of being mated and connected to a first connector configured as the connector, wherein the second connector includes: a plurality of second terminals capable of being electrically connected to a plurality of first terminals that are configured as the plurality of terminals in the first connector; and a second housing that is configured to hold the plurality of second terminals, and is configured to be mated to a first housing that is configured as the housing of the first connector. Also, the second housing is provided with a mating portion that has an opening into which the first housing is to be inserted, and that is mated to the first housing when the first housing is inserted through the opening, and a flat surface that is provided at a position that faces outside through the opening on an inner side of the mating portion, and that extends in a flat manner along a direction perpendicular to a direction in which the first housing is inserted through the opening.

According to this configuration, it is possible to achieve effects similar to those of the terminal according to the above-described aspect of the present invention. In other words, according to this configuration, it is possible to provide the electrical connection apparatus that includes the terminal that can suppress the case in which the positions of the erroneous attachment prevention portion and the withdrawal prevention portion are constrained by the positions of one another, and that realizes a simple structure for ensuring appropriate operation of the erroneous attachment prevention portion. Also, according to the above configuration, the flat surface faces the outside through the opening of the mating portion of the second housing on the inner side of the mating portion of the second housing of the second connector, and extends in a flat manner along the direction perpendicular to the direction in which the first housing of the first connector is inserted. For this reason, when the second connector is suctioned and conveyed by a conveying suction apparatus for mounting to the substrate, the second connector can be easily suctioned on the flat surface. Furthermore, the second connector can be held in a stable state by the conveying suction apparatus. Accordingly, the second connector can be easily mounted to the substrate. Also, as previously described, the first connector of the above-described electrical connection apparatus makes it possible to improve the degree of freedom in design. Therefore, according to the electrical connection apparatus having the above configuration, it is possible to improve the degree of freedom in the design of the first connector, and the second connector can be easily mounted to the substrate.

Note that the above and other objects, features, and advantages of the present invention will become apparent by reading the following description with the attached drawings.

DETAILED DESCRIPTION OF THE INVENTION

Hereinafter, modes for carrying out the present invention will be described with reference to the drawings. Note that the present invention is broadly applicable to a terminal for a connector that is used in a state of being inserted into a housing of the connector, and also to a connector that includes this terminal, and an electrical connection apparatus that includes this connector.

Electrical Connection Apparatus

Figure 1:
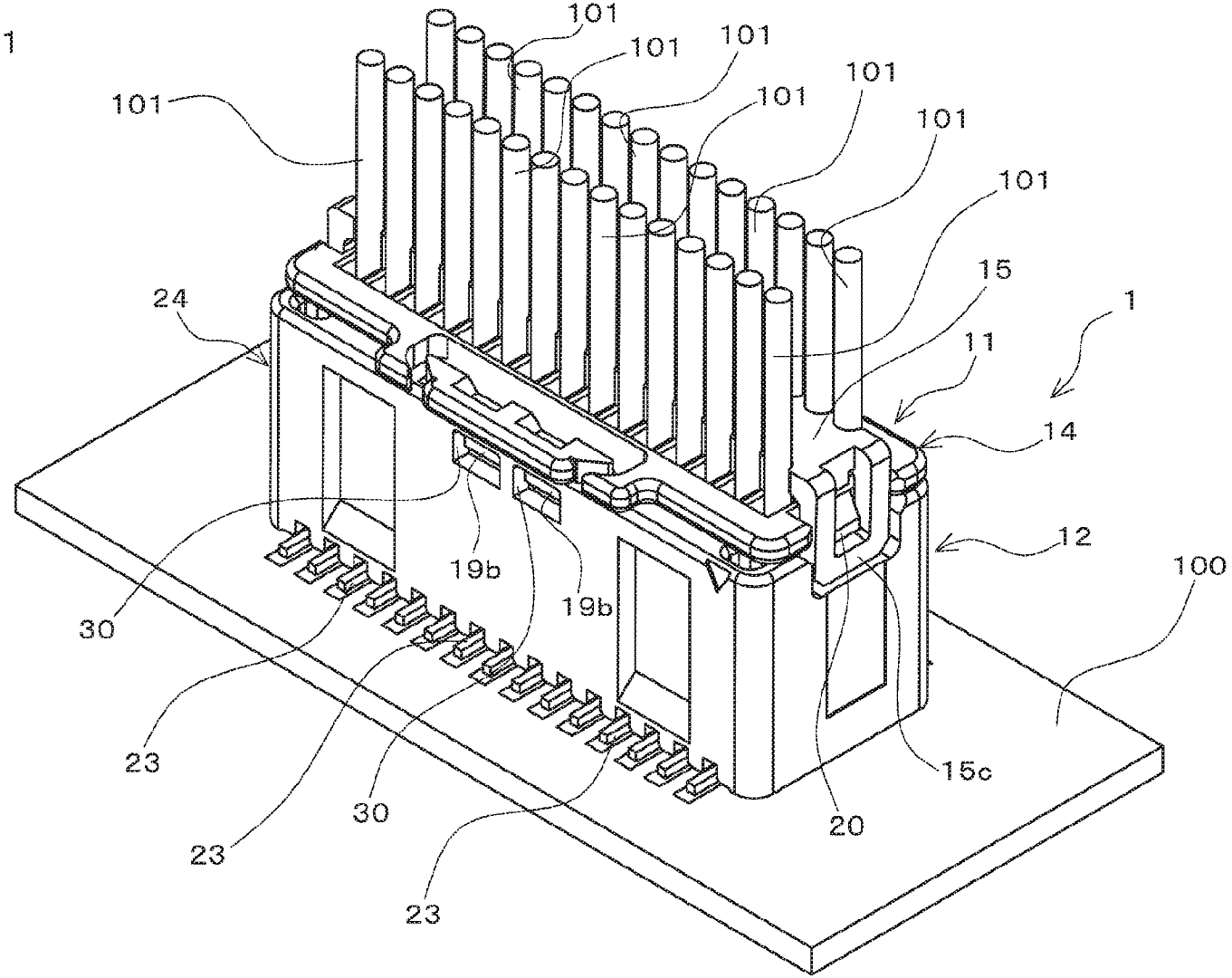
FIG. 1 is a perspective view of an electrical connection apparatus according to an embodiment of the present invention, and shows a substrate and electrical wires as well.
Figure 2:
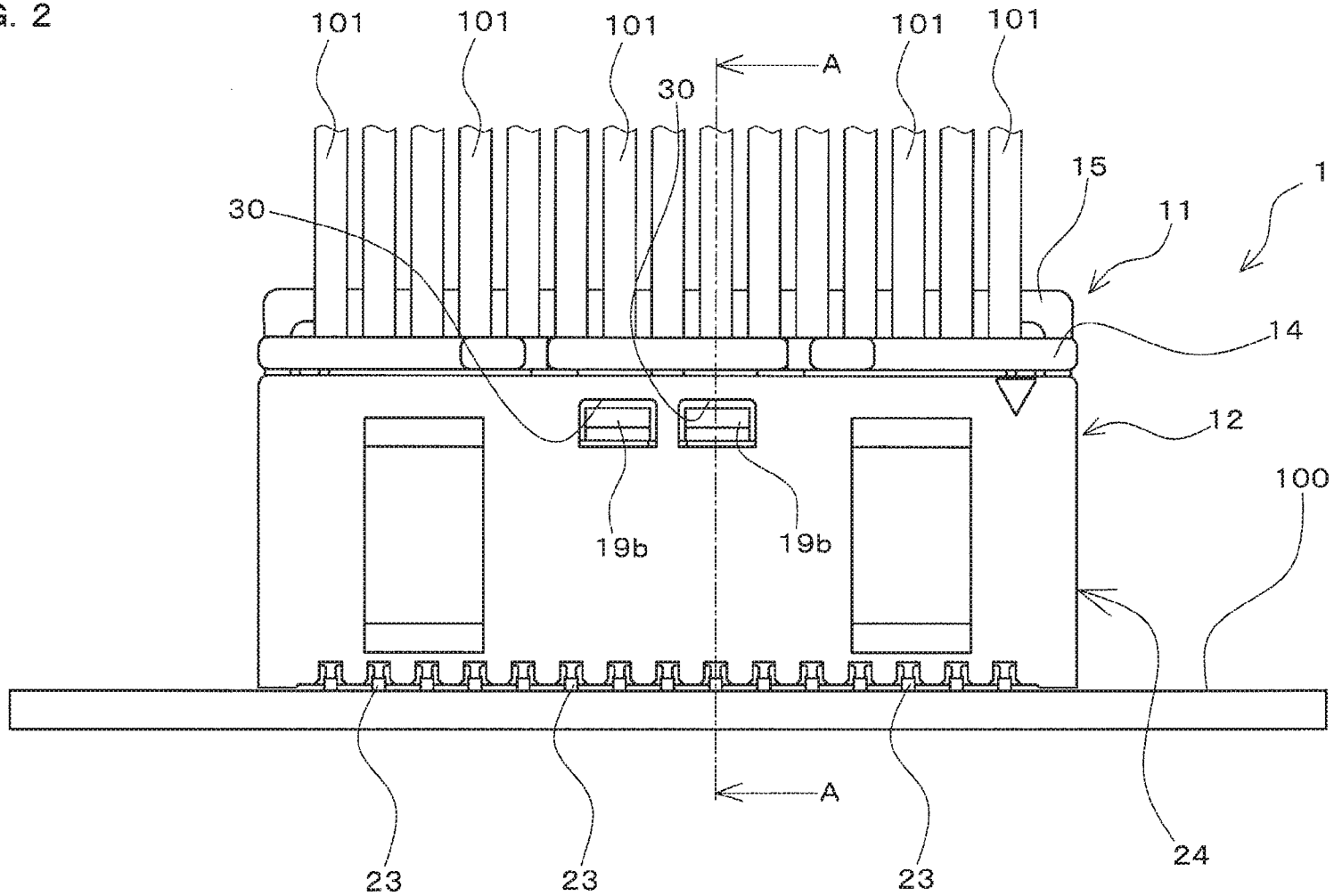
FIG. 2 is a front view of the electrical connection apparatus shown in FIG. 1, and shows the substrate and electrical wires as well.
Figure 3:
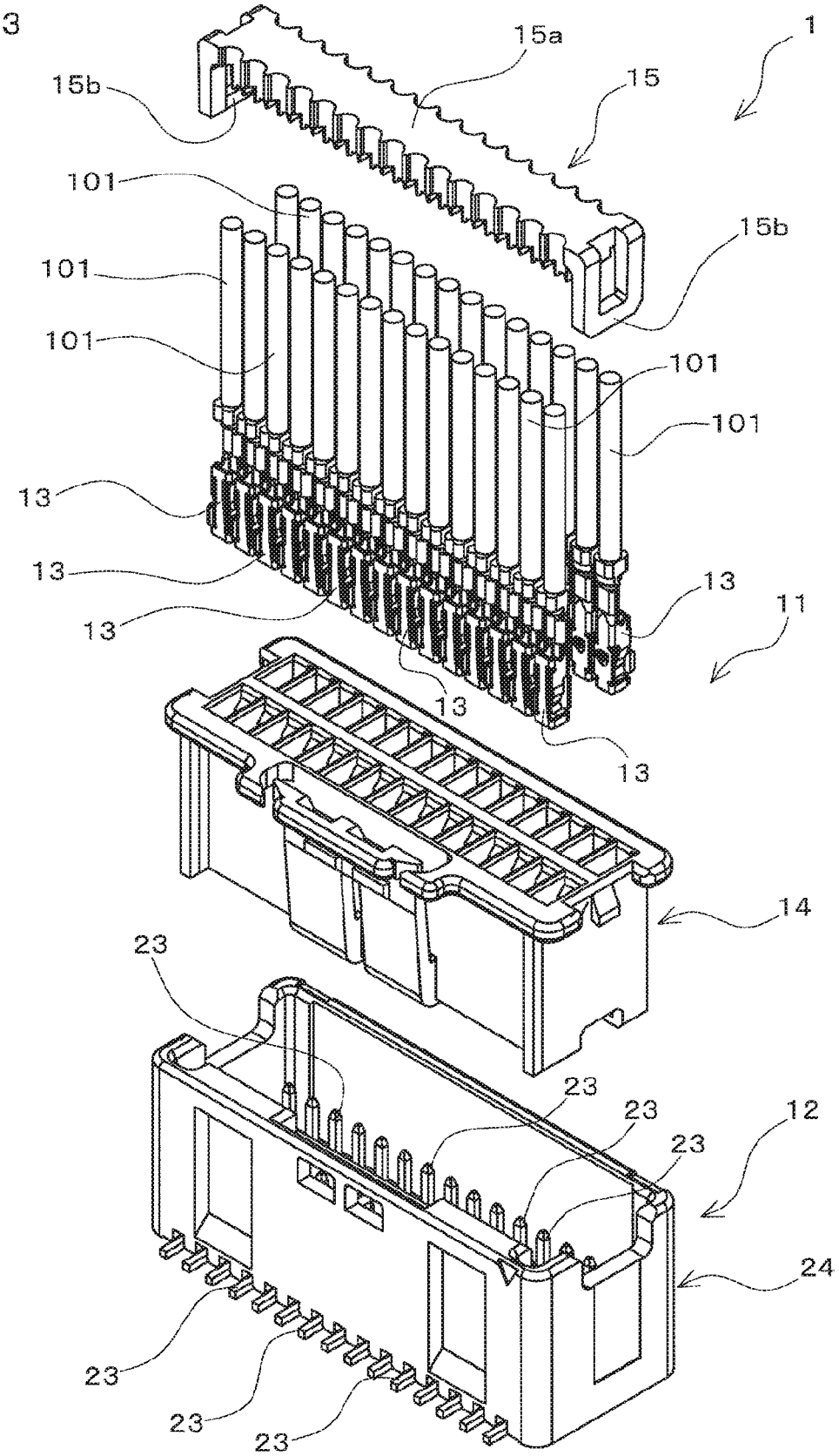
FIG. 3 is an exploded perspective view of the electrical connection apparatus shown in FIG. 1.
Figure 4:
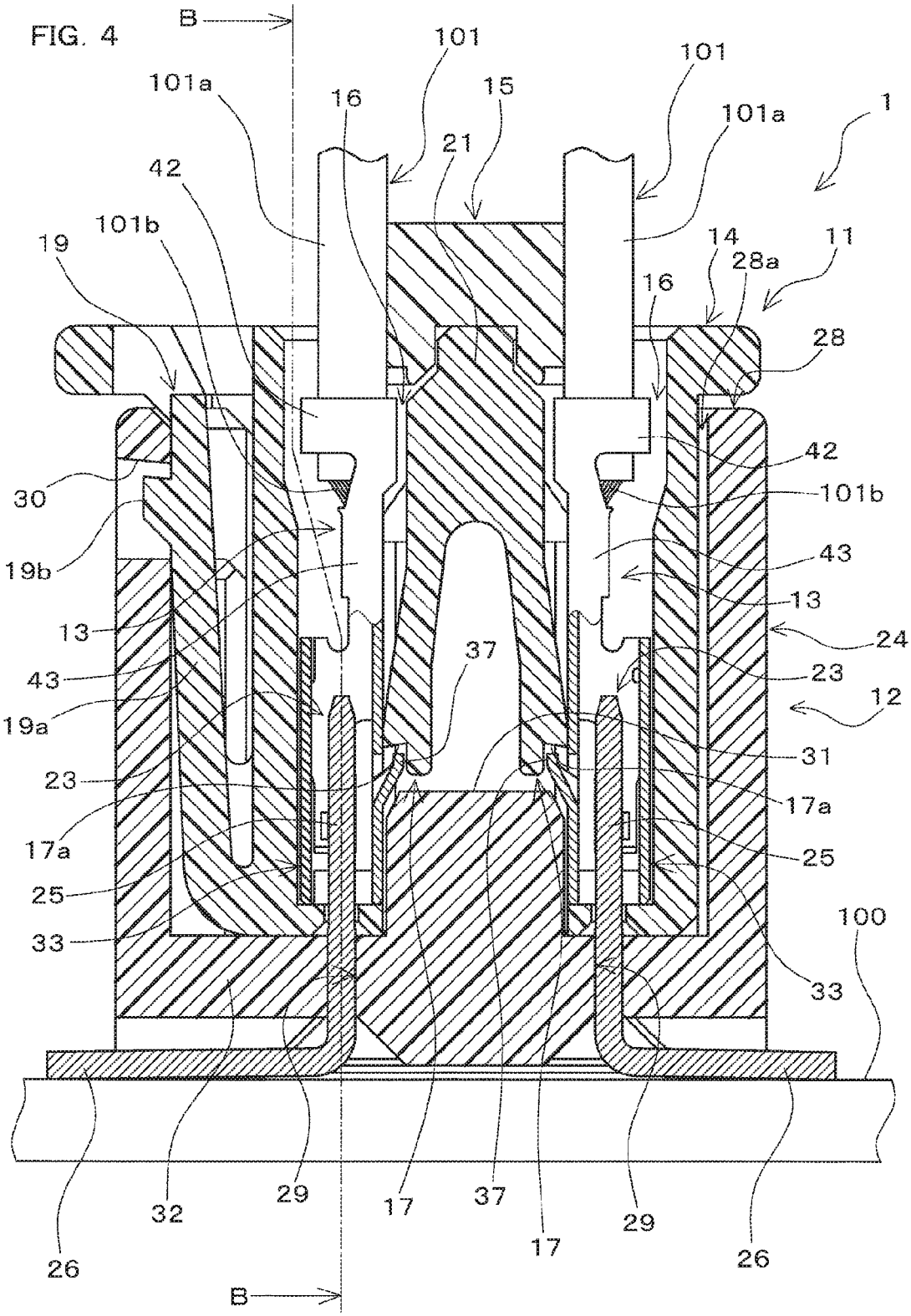
FIG. 4 is a diagram showing a cross-section taken along line A-A in FIG. 2 and viewed in the direction indicated by arrows.
Figure 5:
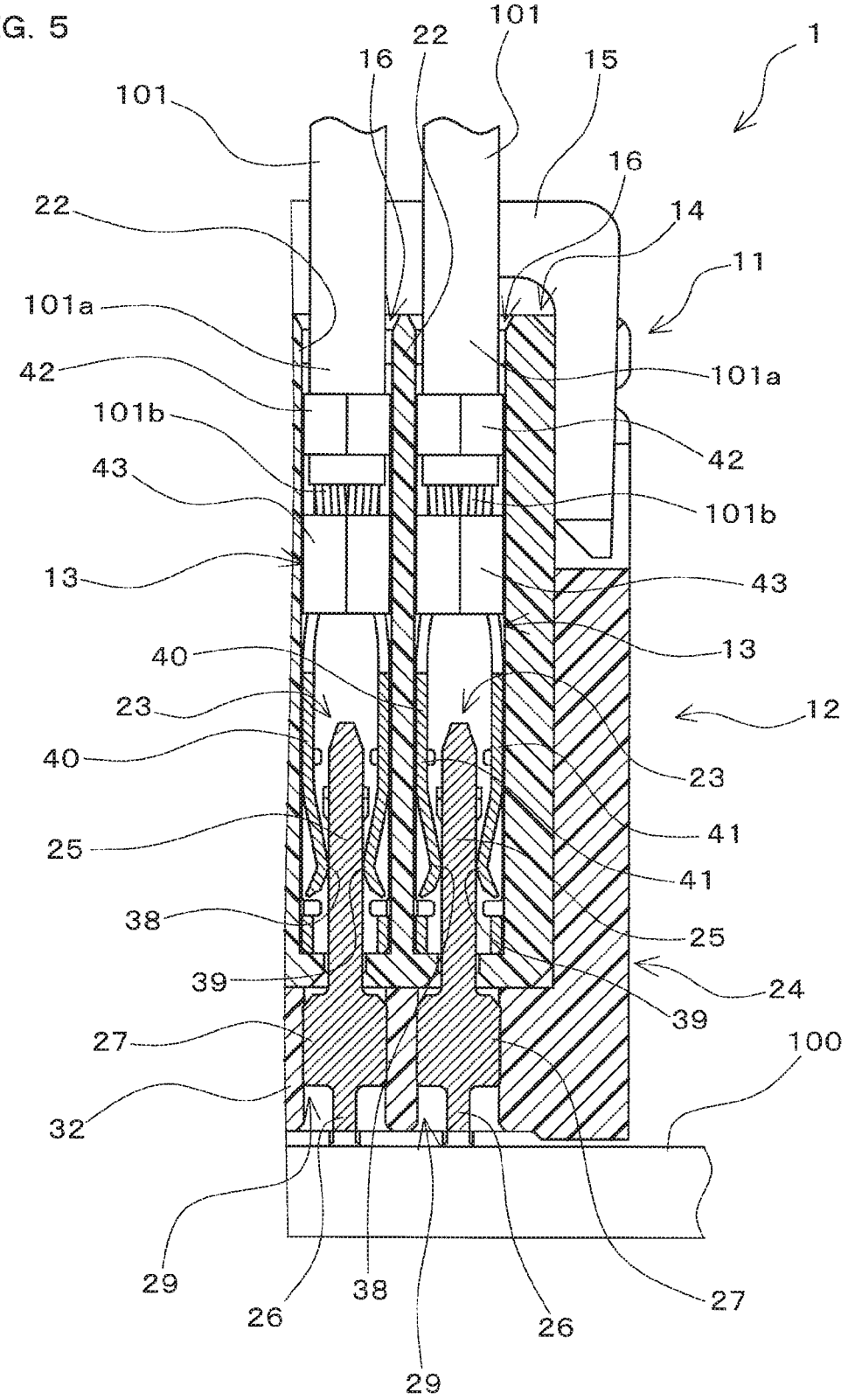
FIG. 5 is a diagram showing a partial cross-section of the electrical connection apparatus shown in FIG. 1, this partial cross-section being taken along line B-B in FIG. 4 and viewed in the direction indicated by arrows.

FIG. 1 is a perspective view of an electrical connection apparatus 1 according to an embodiment of the present invention, and shows a substrate 100 and electrical wires 101 as well. FIG. 2 is a front view of the electrical connection apparatus 1 shown in FIG. 1, and shows the substrate 100 and the electrical wires 101 as well. FIG. 3 is an exploded perspective view of the electrical connection apparatus 1. FIG. 4 is a diagram showing a cross-section taken along line A-A in FIG. 2 and viewed in the direction indicated by arrows. FIG. 5 is a diagram showing a partial cross-section of the electrical connection apparatus 1, this partial cross-section being taken along line B-B in FIG. 4 and viewed in the direction indicated by arrows.

The electrical connection apparatus 1 shown in FIGS. 1 to 5 is provided as an apparatus for electrically connecting the substrate 100 and multiple electrical wires 101. The electrical connection apparatus 1 includes a first connector 11 and a second connector 12. Note that only a partial cutout of the substrate 100 is shown in FIGS. 1, 2, 4, and 5. Also, only partial cutouts of the electrical wires 101 are shown in FIGS. 1 to 5.

The first connector 11 of the electrical connection apparatus 1 is configured to be electrically connected to multiple electrical wires 101, and to be electrically connected to the second connector 12 of the electrical connection apparatus 1. Also, the second connector 12 is configured to be electrically connected to the substrate 100, and to be electrically connected to the first connector 11. When the first connector 11, which is electrically connected to multiple electrical wires 101, is mated with and connected to the second connector 12, which is electrically connected to the substrate 100, the first connector 11 and the partner second connector 12 become mechanically and electrically connected to each other. Also, due to the first connector 11 and the second connector 12 being electrically connected, the electrical wires 101 and the substrate 100 become electrically connected to each other.

First Connector

Figure 6:
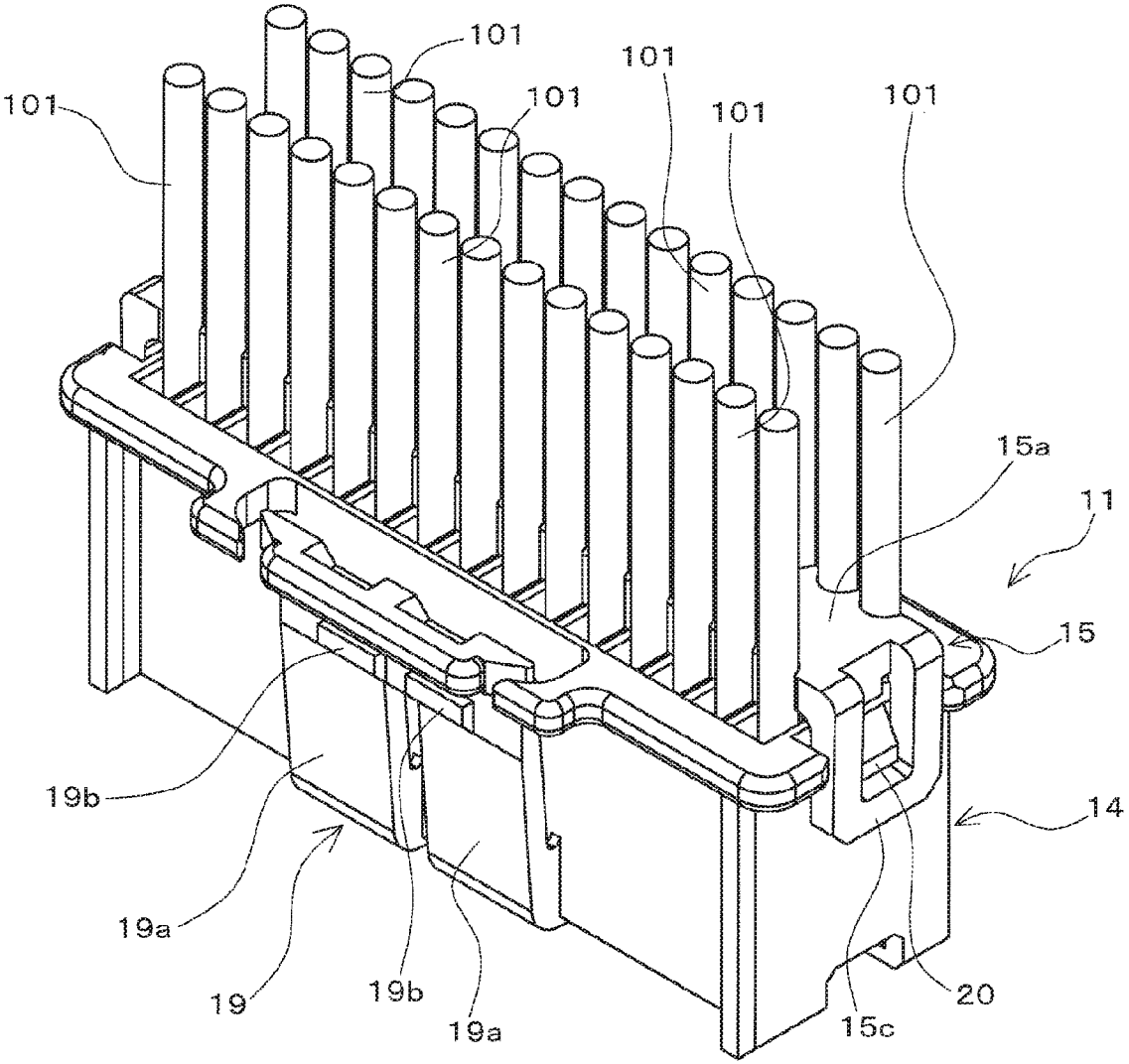
FIG. 6 is a perspective view of a first connector (connector according to an embodiment of the present invention) of the electrical connection apparatus shown in FIG. 1, and shows electrical wires as well.
Figure 7:
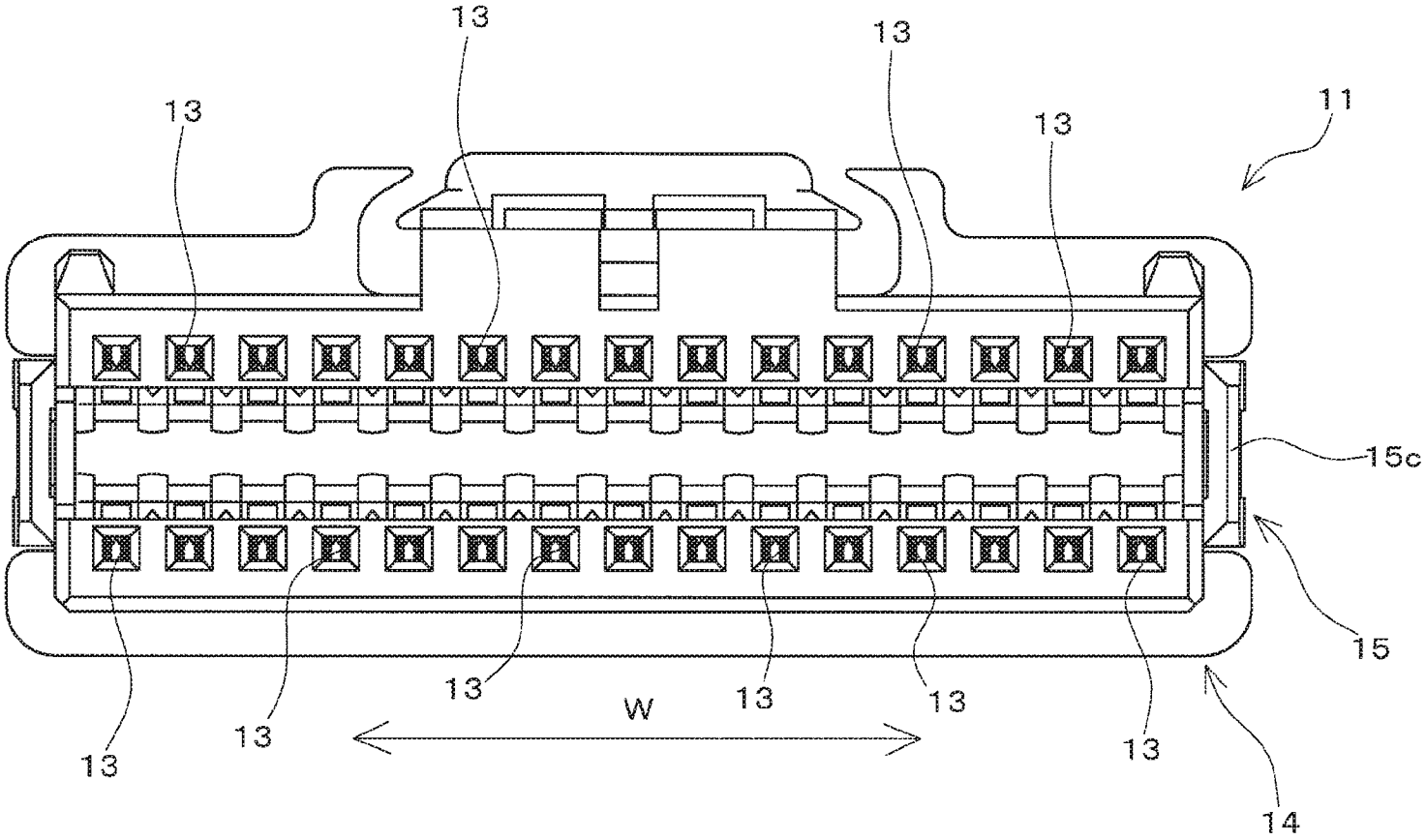
FIG. 7 is a bottom view of the first connector shown in FIG. 6.

FIG. 6 is a perspective view of the first connector 11 of the electrical connection apparatus 1, and shows the electrical wires 101 as well. FIG. 7 is a bottom view of the first connector. The first connector 11 of the electrical connection apparatus 1 constitutes a connector according to an embodiment of the present invention. Note that the first connector 11 will also be called the connector 11 in the following description.

The first connector 11 shown in FIGS. 1 to 7 includes multiple first terminals 13, a first housing 14, and a retainer 15. The first terminals 13 each constitute a terminal according to an embodiment of the present invention. Also, the first housing 14 constitutes the housing of the connector 11 (first connector 11) according to an embodiment of the present invention. Note that the first terminals 13 will also be called the terminals 13 in the following description. Also, the first housing 14 will also be called the housing 14.

The first terminals 13 of the first connector 11 shown in FIGS. 3 to 5 and 7 are configured to be mechanically and electrically connected to the electrical wires 101. Note that FIG. 4 shows a partial cutaway cross-section of first terminals 13. The first terminals 13 are each formed by a metal material that has electrical conductivity. The first terminals 13 are crimped to end portions of respective electrical wires 101 so as to be attached and fixed thereto, thus being mechanically and electrically connected to the electrical wires 101. The first terminals 13 with the electrical wires 101 connected thereto are inserted into the first housing 14. When inserted into the first housing 14, the first terminals 13 engage with inner portions of the first housing 14 and are held in the first housing 14. Note that details of the configuration of the first terminals 13 will be described later.

Figure 8:
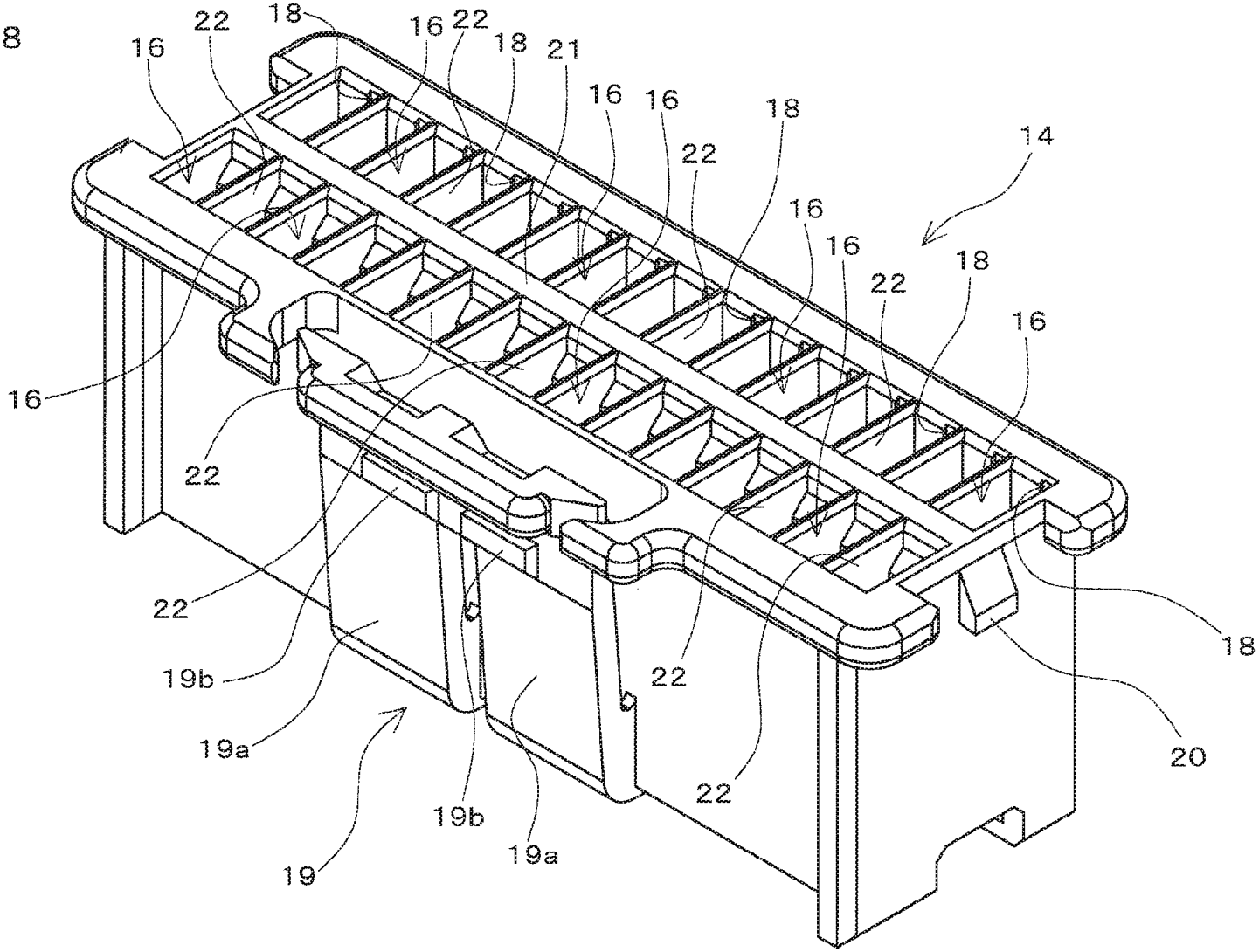
FIG. 8 is a perspective view of a first housing (housing according to an embodiment of the present invention) of the first connector shown in FIG. 6.
Figure 9:
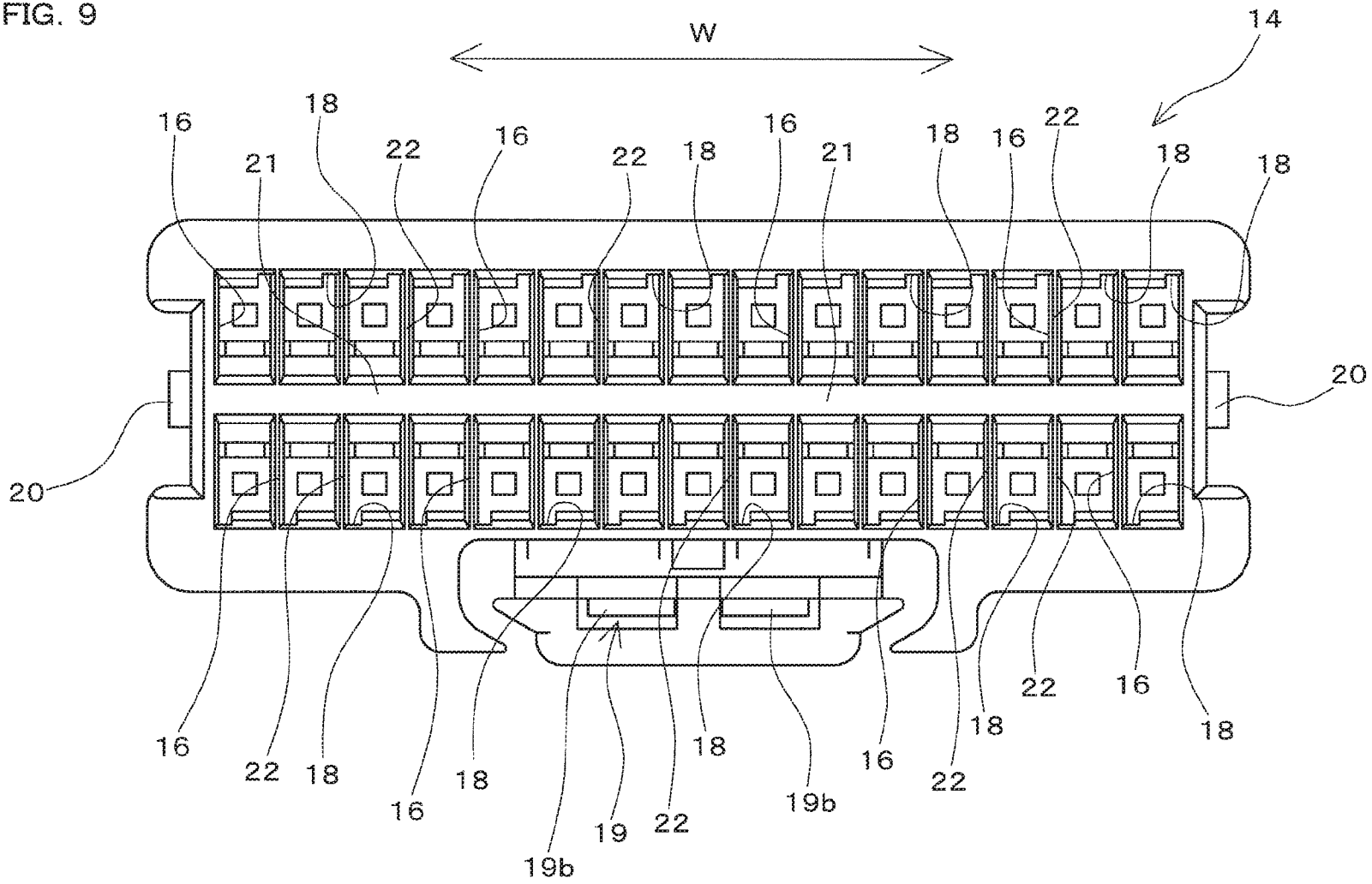
FIG. 9 is a plan view of the first housing shown in FIG. 8.

FIG. 8 is a perspective view of the first housing 14 of the first connector 11. FIG. 9 is a plan view of the first housing 14. The first housing 14 shown in FIGS. 1 to 9 is configured to hold multiple first terminals 13. Note that FIGS. 8 and 9 show the first housing 14 in the state of not holding first terminals 13.

The first housing 14 is formed by a resin material that has insulating properties. The first housing 14 is provided with multiple terminal insertion holes 16, multiple engaged portions 17, multiple insertion orientation restriction grooves 18, a retaining portion 19, retainer engaging portions 20, and the like.

The terminal insertion holes 16 are provided as holes that receive insertion of and hold the first terminals 13. The terminal insertion holes 16 are provided as holes that have an approximately quadrangular cross-sectional shape, for example. The terminal insertion holes 16 of the first housing 14 are provided side-by-side in two rows along the width direction of the first housing 14. The width direction of the first housing 14 is indicated by a double-headed arrow W in FIGS. 7 and 9. Note that the width direction of the first housing 14 is the same direction as the width direction of the first connector 11.

Also, the terminal insertion holes 16 are each provided as a hole that is defined by a row partition wall 21 and terminal partition walls 22 inside the first housing 14. The row partition wall 21 is provided as a partition wall that extends along the width direction of the first housing 14 inside the first housing 14. The rows of terminal insertion holes 16, which are provided side-by-side in two rows along the width direction of the first housing 14, are divided by the row partition wall 21. The terminal partition walls 22 are provided on both sides of the row partition wall 21. The terminal partition walls 22 are each provided in a manner of extending perpendicularly to the row partition wall 21. The region between adjacent terminal partition walls 22 is configured as the region in which a terminal insertion hole 16 is defined.

As shown in FIG. 4, the engaged portions 17 are provided inside the first housing 14. The engaged portions 17 are provided side-by-side on both sides of the row partition wall 21 inside the first housing 14. The engaged portions 17 are provided at positions that respectively correspond to the terminal insertion holes 16. Also, the engaged portions 17 are each configured such that later-described engaging portions 37 of the first terminals 13 can be engaged thereto.

The engaged portions 17 provided on the row partition wall 21 are provided in correspondence with the terminal insertion holes 16 inside the first housing 14, and are furthermore provided as portions that extend in a cantilevered manner so as to be capable of elastically deforming by bending. The engaged portions 17 are each provided with a recession portion 17*a* that is recessed in a step-like shape in the leading end portion that extends from the row partition wall 21 in a cantilevered manner. The recession portions 17*a* of the engaged portions 17 are provided so as to be capable of being engaged with the engaging portions 37 of the first terminals 13.

As shown in FIGS. 8 and 9, multiple insertion orientation restriction grooves 18 are provided in the first housing 14. The insertion orientation restriction grooves 18 are provided in correspondence with the terminal insertion holes 16. Also, the insertion orientation restriction grooves 18 are each provided as a groove into which a later-described projection portion 36 of a first terminal 13 fits. When a first terminal 13 is inserted into a terminal insertion hole 16 in an orientation in which the protrusion portion 36 of the first terminal 13 fits into the insertion orientation restriction groove 18, the insertion of the first terminal 13 into the terminal insertion hole 16 is allowed. However, when a first terminal 13 is inserted into a terminal insertion hole 16 in an orientation different from the orientation in which the protrusion portion 36 of the first terminal 13 fits into the insertion orientation restriction groove 18, the insertion of the first terminal 13 into the terminal insertion hole 16 is restricted.

The end portions of the insertion orientation restriction grooves 18 on one side are provided at positions that are exposed to the outside through the openings of the terminal insertion holes 16. Also, the insertion orientation restriction grooves 18 are each provided as a groove that extends along a wall surface that defines the terminal insertion hole 16, and provided as a groove that extends along the direction in which the hole shape of the terminal insertion hole 16 extends. The insertion orientation restriction grooves 18 are arranged at positions that are eccentric to one side in the width direction of the first housing 14 in a cross-section of the approximately quadrangular terminal insertion holes 16. Note that in the present embodiment, the insertion orientation restriction grooves 18 are each provided at a position that corresponds to one of the four corner portions of the cross-section of the approximately quadrangular terminal insertion hole 16.

The retaining portion 19 is provided as a portion that engages with the second connector 12 when the first connector 11 is mated with and connected to the second connector 12, and is provided as a mechanism for preventing the first connector 11 from coming out of and falling out of the second connector 12. The retaining portion 19 includes a pair of arms (19*a*, 19*a*) and a pair of protrusion portions (19*b*, 19*b*).

The pair of arms (19*a*, 19*a*) are provided so as to extend in a cantilevered manner substantially parallel to each other from one outer wall surface of the first housing 14, and are capable of elastically deforming by bending. Also, the pair of arms (19*a*, 19*a*) are each provided so as to extend in a cantilevered manner along the direction opposite to the direction in which the first connector 11 is mated to the second connector 12. Furthermore, leading end portions of the pair of arms (19*a*, 19*a*) that extend in a cantilevered manner are integrated with each other.

The pair of protrusion portions (19*b*, 19*b*) are provided on the leading end portions of the pair of arms (19*a*, 19*a*) that extend in a cantilevered manner. Specifically, the pair of protrusion portions (19*b*, 19*b*) are provided on the leading end portions of the pair of arms (19*a*, 19*a*) that are integrated with each other. Furthermore, the pair of protrusion portions (19*b*, 19*b*) are provided as portions that convexly rise toward the outside of the first housing 14 on the integrated leading end portions of the pair of arms (19*a*, 19*a*).

When the first connector 11 is to be mated and connected to the second connector 12, the first housing 14 of the first connector 11 is inserted into and mated to the later-described second housing 24 of the second connector 12. When the first housing 14 is inserted into the second housing 24, the pair of protrusion portions (19*b*, 19*b*) come into contact with a wall portion of the second housing 24, and the pair of arms (19*a*, 19*a*) temporarily bend toward the inside of the first housing 14. Thereafter, the pair of arms (19*a*, 19*a*) undergo elastic recovery toward the outside of the first housing 14, and the pair of protrusion portions (19*b*, 19*b*) are respectively fitted into and engage with a later-described pair of engagement holes (30, 30) that are provided in a wall portion of the second housing 24. Accordingly the first connector 11 that is mated and connected to the second connector 12 is prevented from coming out of and falling out of the second connector 12.

The retainer engaging portions 20 are provided as portions for engagement with the retainer 15 attached to the first housing 14. A pair of retainer engaging portions 20 are provided, one on each side in the width direction of the first housing 14. The retainer engaging portions 20 are each provided as a portion that convexly rises toward the outside of the first housing 14. When the retainer 15 is engaged with the first housing 14 by the retainer engaging portions 20, the retainer 15 is fixed to and held by the first housing 14.

The retainer 15 shown in FIGS. 1 to 7 is configured so as to be attached to the first housing 14 in a state where the first terminals 13 are held in the first housing 14. Also, the retainer 15 is provided as an element for more reliably preventing the first terminals 13 from coming out of the first housing 14. Note that the first terminals 13 are each prevented from coming out of the first housing 14 by the later-described engaging portions 37 engaging with the engaged portions 17 inside the first housing 14. By attaching the retainer 15 to the first housing 14 in the state where the first terminals 13 are held in the first housing 14, the first terminals 13 are more reliably prevented from coming out of the first housing 14.

The retainer 15 includes a retainer main body portion 15*a* that extends along the width direction of the first connector 11, and a pair of housing engaging portions (15*b*, 15*b*) that engage with the pair of retainer engaging portions (20, 20) of the first housing 14.

The pair of housing engaging portions (15*b*, 15*b*) are provided on respective sides in the width direction of the retainer main body portion 15*a*. The housing engaging portions 15*b* are each formed as an annular portion provided with a hole into which a retainer engaging portion 20 fits. When the retainer 15 is attached to the first housing 14, the housing engaging portions 15*b* temporarily bend due to coming into contact with the retainer engaging portions 20 and elastically deforming. Thereafter, the housing engaging portions 15*b* undergo elastic recovery, and the retainer engaging portions 20 are fitted into and engaged with the holes of the housing engaging portions 15*b*. Accordingly, the retainer 15 is attached to the first housing 14.

Also, the retainer main body portion 15*a* is provided with grooves that respectively correspond to the electrical wires 101 connected to the first terminals 13. In the state where the retainer 15 is attached to the first housing 14, the electrical wires 101 connected to the first terminals 13 are arranged in a state of extending in a straight manner along the inside of the grooves of the retainer main body portion 15*a*. Also, the end portions on one side of the grooves provided in the retainer main body portion 15*a* are arranged so as to be capable of abutting against the end portions of the first terminals 13 connected to the electrical wires 101. If a first terminal 13 becomes displaced in the direction of removal from the first housing 14, the end portion of that first terminal 13 abuts against the end portion of the corresponding groove of the retainer main body portion 15*a*. Accordingly, the first terminals 13 are more reliably prevented from coming out of the first housing 14.

Second Connector

Figure 10:
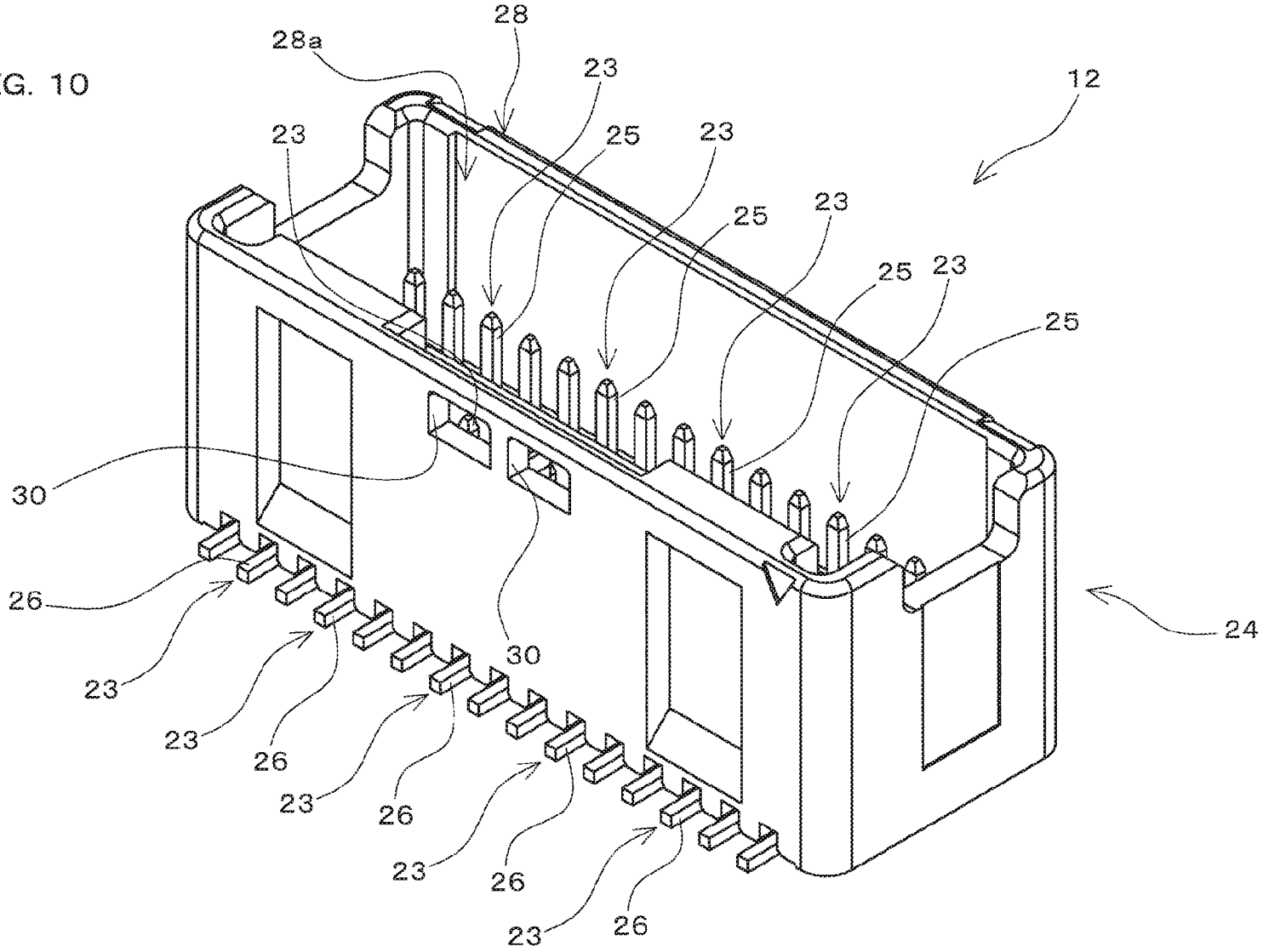
FIG. 10 is a perspective view of a second connector of the electrical connection apparatus shown in FIG. 1.
Figure 11:
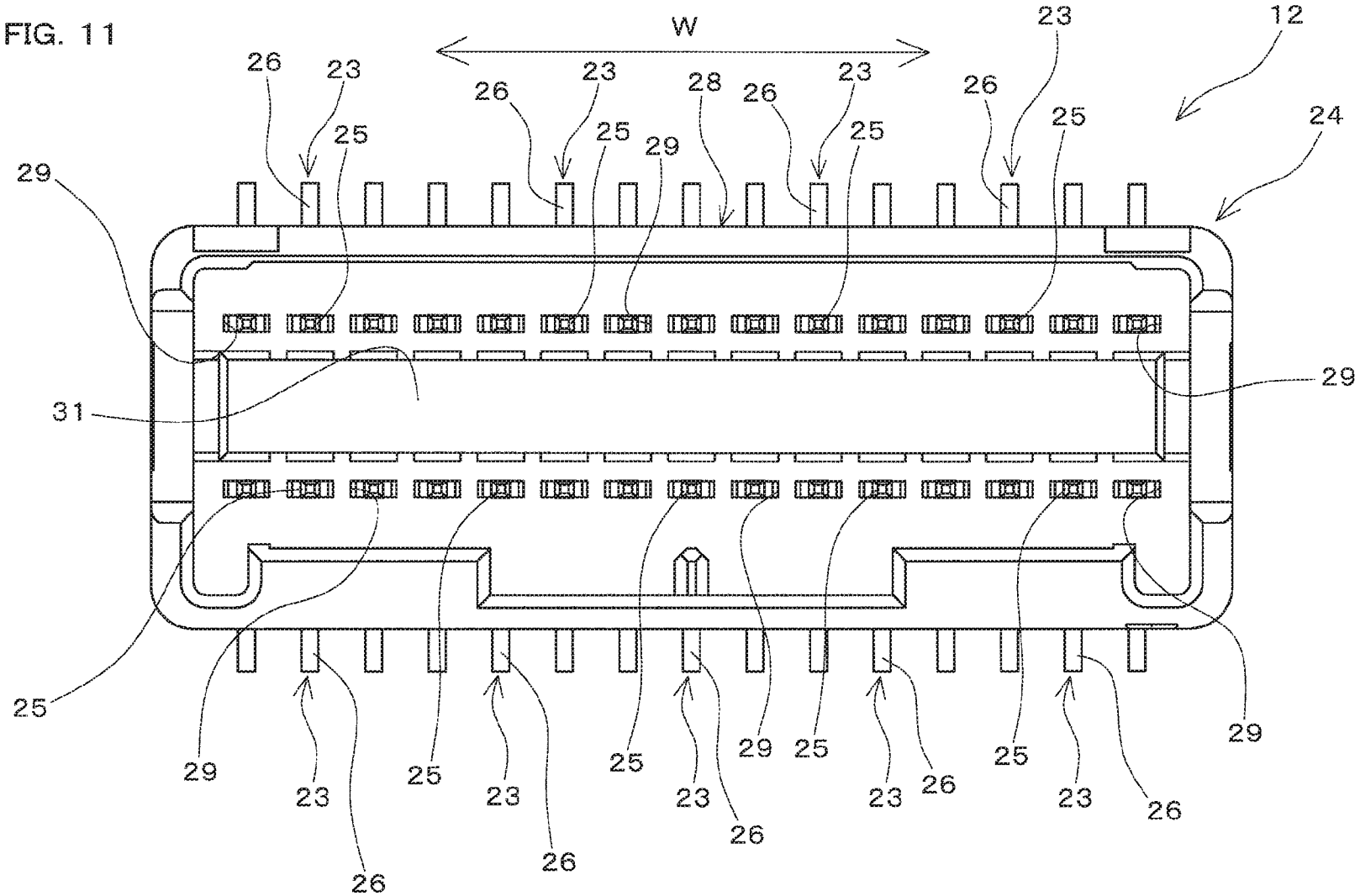
FIG. 11 is a plan view of the second connector shown in FIG. 10.
Figure 12:
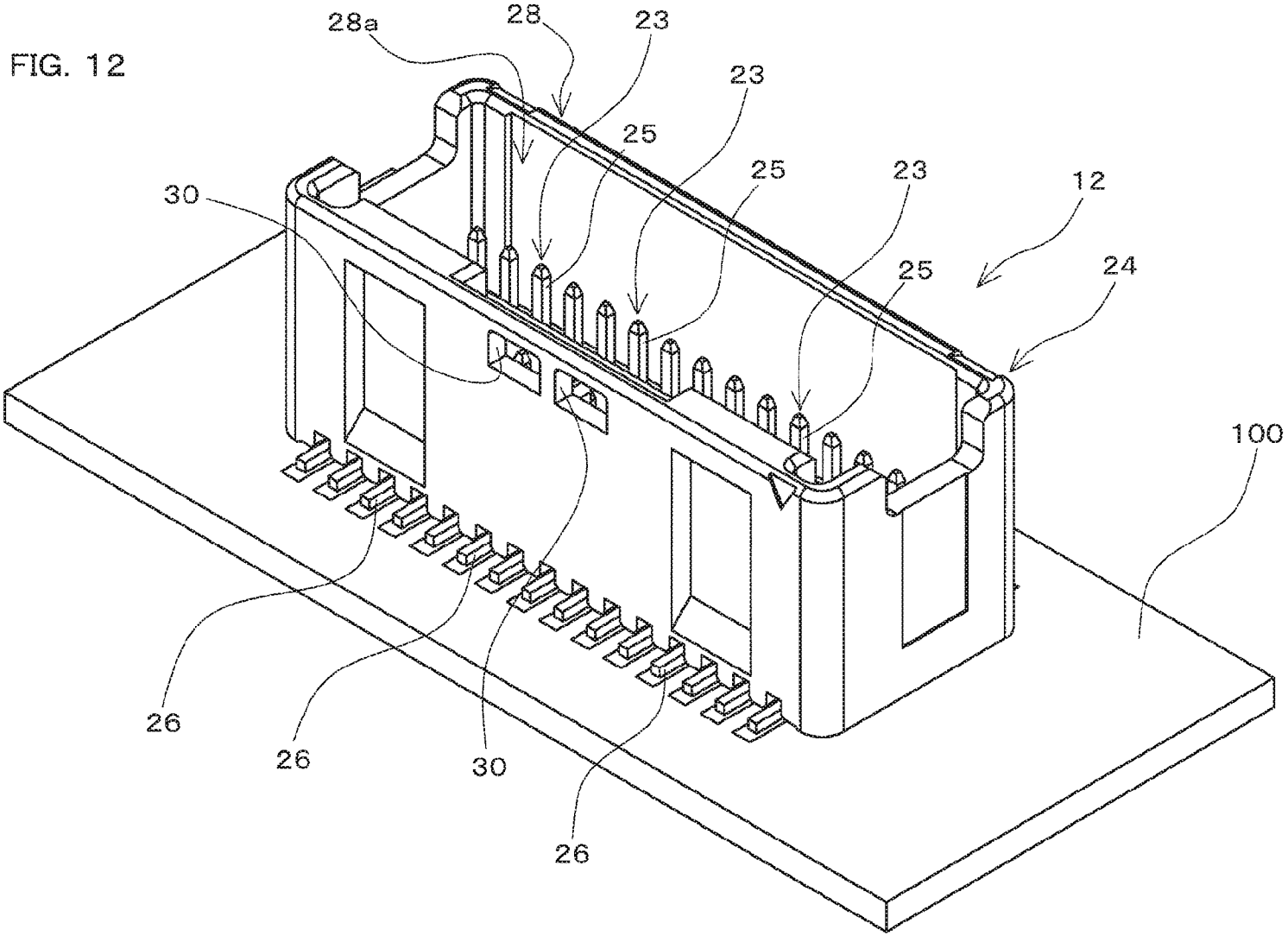
FIG. 12 is a perspective view of the second connector shown in FIG. 10, and shows the substrate as well.

FIG. 10 is a perspective view of the second connector 12 of the electrical connection apparatus 1. FIG. 11 is a plan view of the second connector 12. FIG. 12 is a perspective view of the second connector 12, and shows the substrate 100 as well.

The second connector 12 shown in FIGS. 1 to 5 and 10 to 12 is mated and connected to the first connector 11 constituted as the connector 11 according to an embodiment of the present invention. The second connector 12 is connected to the first connector 11 in the state of being connected to the substrate 100. Also, the second connector 12 includes multiple second terminals 23 and a second housing 24.

The second terminals 23 of the second connector 12 shown in FIGS. 1 to 5 and 10 to 12 are held in the second housing 24 of the second connector 12. Also, the second terminals 23 are configured to be mechanically and electrically connected to the first terminals 13 of the first connector 11. More specifically the second terminals 23 are mechanically and electrically connected to the first terminals 13 due to being mated to the first terminals 13 when the first connector 11 is mated and connected to the second connector 12.

Also, the second terminals 23 are each formed by a metal material that is electrically conductive, and are mechanically and electrically connected to the substrate 100. More specifically, the second terminals 23 are soldered to the surface of the substrate 100 so as to be mechanically fixed to the substrate 100 and also electrically connected to a conductive circuit pattern of the substrate 100.

Also, the second terminals 23 of the second housing 24 are arranged side-by-side in two rows along the width direction of the second housing 24. The width direction of the second housing 24 is indicated by a double-headed arrow W in FIG. 11. Note that the width direction of the second housing 24 is the same direction as the width direction of the second connector 12. Also, in the state where the second connector 12 and the first connector 11 are mated and connected to each other, the width direction of the second connector 12 is the same direction as the width direction of the first connector 11.

The second terminals 23 are each provided with one portion that is bent approximately 90 degrees, and has an overall shape of extending substantially in an "L" shape. The second terminals 23 are each provided with a terminal connection portion 25, a substrate connection portion 26, and a press-fit portion 27.

The terminal connection portions 25 are each provided as the portion on one end side in the longitudinal direction of the second terminal 23 that extends substantially in an "L" shape. Also, the terminal connection portions 25 are configured to be mechanically and electrically connected to the first terminals 13 of the first connector 11 by being mated to the first terminals 13. Note that the terminal connection portions 25 are arranged inside the second housing 24 of the second connector 12 in a manner of protruding and extending in a cantilevered manner along a direction parallel to the direction in which the first connector 11 and the second connector 12 are mated to each other.

The substrate connection portions 26 are each provided as the portion on the other end side in the longitudinal direction of the second terminal 23 that extends substantially in an "L" shape. In other words, the substrate connection portions 26 are each provided as the portion on the side opposite to the terminal connection portion 25 side in the longitudinal direction of the second terminal 23 that extends substantially in an "L" shape. Also, the substrate connection portions 26 are configured to be mechanically and electrically connected to the substrate 100 by being soldered to the substrate 100. Note that the substrate connection portions 26 are arranged such that the leading end portions thereof protrude and extend toward the outside of the second housing 24 along a direction substantially perpendicular to the direction in which the first connector 11 and the second connector 12 are mated to each other.

The press-fit portions 27 are each provided as a portion that is engaged with and fixed to the second housing 24 by being press-fitted into a terminal press-fit hole 29 of the second housing 24 when the second terminal 23 is press-fitted into and held in the second housing 24 (see FIGS. 4 and 5). More specifically, the press-fit portions 27 are each provided as an intermediate portion in the longitudinal direction of the second terminal 23 that extends substantially in an "L" shape, and provided between the terminal connection portion 25 and the portion of the second terminal 23 that is bent approximately 90 degrees. Also, the press-fit portions 27 are each provided as a portion that is wider than the terminal connection portion 25 in the width direction that is perpendicular to the longitudinal direction of the second terminal 23. In other words, the press-fit portions 27 are each provided as a wide-width portion that has a wider width in a portion in the longitudinal direction of the second terminal 23 that extends substantially in an "L" shape.

When the second terminals 23 are press-fitted into and held in the second housing 24, the second terminals 23 are inserted into the terminal press-fit holes 29 of the second housing 24 from the terminal connection portion 25 side. The terminal connection portions 25 then pass through the terminal press-fit holes 29 and are placed inside the second housing 24, and the press-fit portions 27 are press-fitted into the terminal press-fit holes 29 in this state. Accordingly, the press-fit portions 27 are engaged with and fixed to the second housing 24 by press-fitting, and the second terminals 23 are held in the second housing 24.

The second housing 24 of the second connector 12 shown in FIGS. 1 to 5 and 10 to 12 is configured to hold multiple second terminals 23. Also, the second housing 24 is configured to be mated with the first housing 14 of the first connector 11.

The second housing 24 is formed by a resin material that has insulating properties, and includes a rectangular tube-shaped portion that has an approximately rectangular cross-sectional shape. The second housing 24 is also provided with a mating portion 28, multiple terminal press-fit holes 29, a pair of engagement holes (30, 30), a flat surface 31, and the like.

The mating portion 28 has an approximately rectangular opening 28*a* into which the first housing 14 of the first connector 11 is inserted. Also, the mating portion 28 is provided as the portion to which the first housing 14 is mated when inserted through the opening 28*a*. The terminal connection portions 25 of multiple second terminals 23 are arranged on the inner side of the mating portion 28 that faces the outside via the opening 28*a* of the mating portion 28.

The terminal press-fit holes 29 are provided as holes into which the press-fit portions 27 of the second terminals 23 are press-fitted and held. Also, the terminal press-fit holes 29 are provided as through-holes that have a cross-sectional shape that corresponds to the cross-sectional shape of the press-fit portions 27 of the second terminals 23. The terminal press-fit holes 29 are each formed so as to pass through a wall portion 32 of an end portion of the second housing 24 that is on the side opposite to the opening 28*a* side of the mating portion 28. Also, the terminal press-fit holes 29 are provided side-by-side in two rows along the width direction of the second housing 24 in the wall portion 32 of the second housing 24 on the side opposite to the opening 28*a* side.

The pair of engagement holes (30, 30) are provided as through-holes that the pair of protrusion portions (19*b*, 19*b*) of the retaining portion 19 of the first housing 14 are fitted into and engage with when the first housing 14 is inserted into and mated to the second housing 24. The pair of engagement holes (30, 30) are provided side-by-side in the second housing 24 in the vicinity of an edge portion, which is on the opening 28*a* side, of a wall portion that constitutes a portion of the mating portion 28. Also, the pair of engagement holes (30, 30) are provided in the second housing 24 at positions that correspond to the pair of protrusion portions (19*b*, 19*b*) when the first housing 14 has been mated to the second housing 24.

When the first housing 14 is to be mated to the second housing 24, the pair of arms (19*a*, 19*a*) temporarily bend inside the second housing 24 and then undergo elastic recovery, and thus the pair of protrusion portions (19*b*, 19*b*) are respectively fitted into the pair of engagement holes (30, 30). Also, the protrusion portions 19*b* are fitted into the engagement holes 30 in a state of being capable of engaging with the edge portions of the engagement holes 30 on the opening 28*a* side. Accordingly, even if external force in the direction opposite to the direction of mating to the second housing 24 acts on the first housing 14 that is mated to the second housing 24, the pair of protrusion portions (19*b*, 19*b*) and the pair of engagement holes (30, 30) engage with each other, thus preventing the first housing 14 from coming out of and falling out of the second housing 24. In other words, the first connector 11 that is mated and connected to the second connector 12 is prevented from coming out of and falling out of the second connector 12.

The flat surface 31 is configured as a flat surface provided on the inner side of the second housing 24. More specifically, the flat surface 31 is provided at a position that faces the outside through the opening 28*a* on the inner side of the mating portion 28, and is configured as a surface that extends in a flat manner along the direction perpendicular to the direction in which the first housing 14 is inserted through the opening 28*a* (see FIGS. 4 and 11). Also, the flat surface 31 is configured as a surface in the second housing 24 that extends in a flat manner and is elongated in the width direction of the second housing 24. Furthermore, the flat surface 31 is arranged between the two rows of second terminals 23 that are arranged side-by-side along the width direction of the second housing 24. For this reason, the flat surface 31 is arranged as a wide and flat expansion in the central region on the inner side of the mating portion 28.

When the second connector 12 is suctioned and conveyed by a conveying suction apparatus (not shown) for mounting to the substrate 100, the second connector 12 is suctioned by the suction apparatus on the flat surface 31 of the second housing 24. The second connector 12, which is suctioned by the suction apparatus on the flat surface 31, is conveyed to a predetermined position on the substrate 100 at which solder paste has been applied, and is then placed on that predetermined position. When the second connector 12 is placed on the predetermined position of the substrate 100, the suctioning of the flat surface 31 by the suction apparatus is stopped. Thereafter, the solder is heated, thus soldering and fixing the second connector 12 to the substrate 100.

First Terminal

Figure 13:
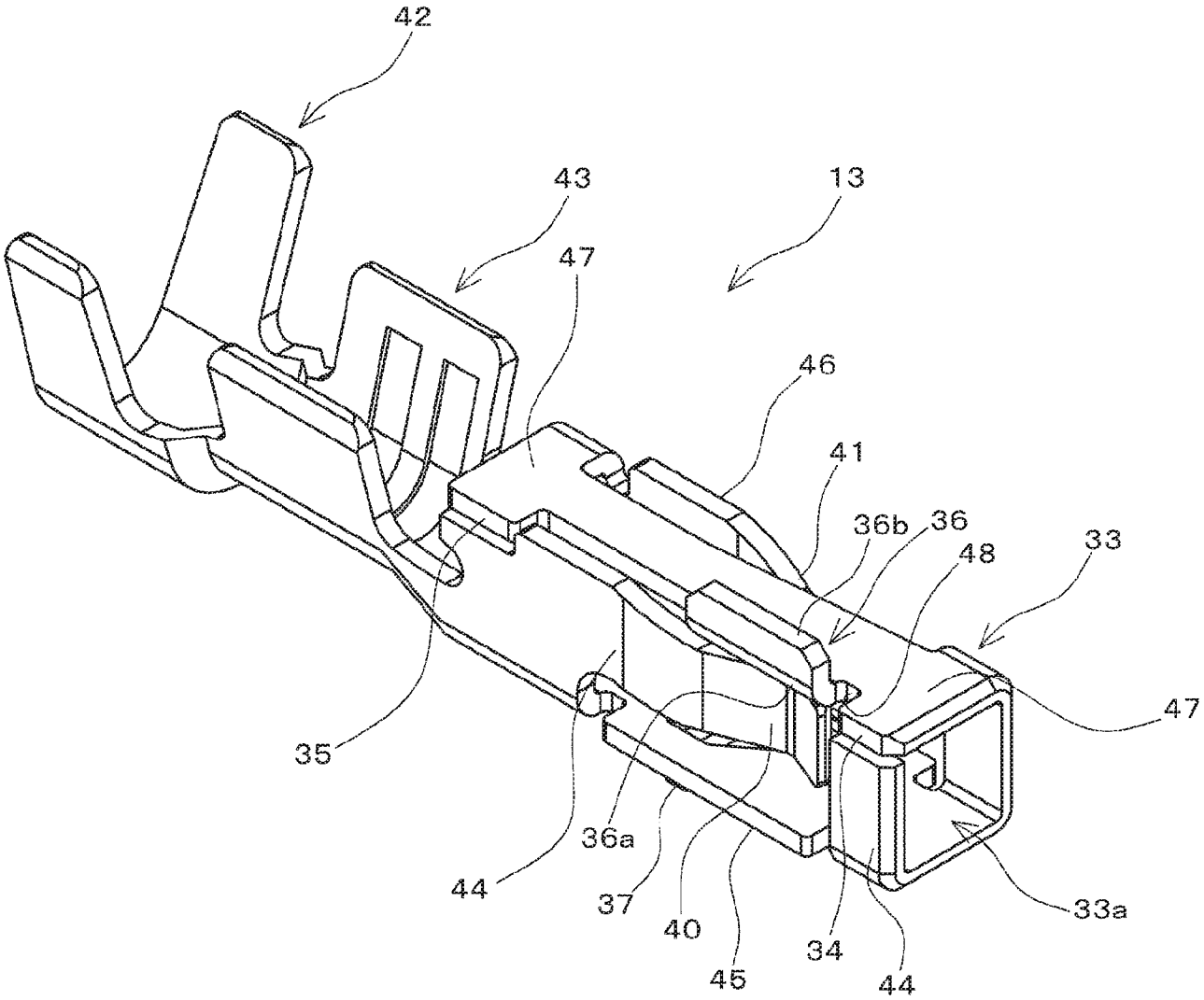
FIG. 13 is a perspective view of a first terminal (terminal according to an embodiment of the present invention) of the first connector of the electrical connection apparatus shown in FIG. 1.
Figure 14:
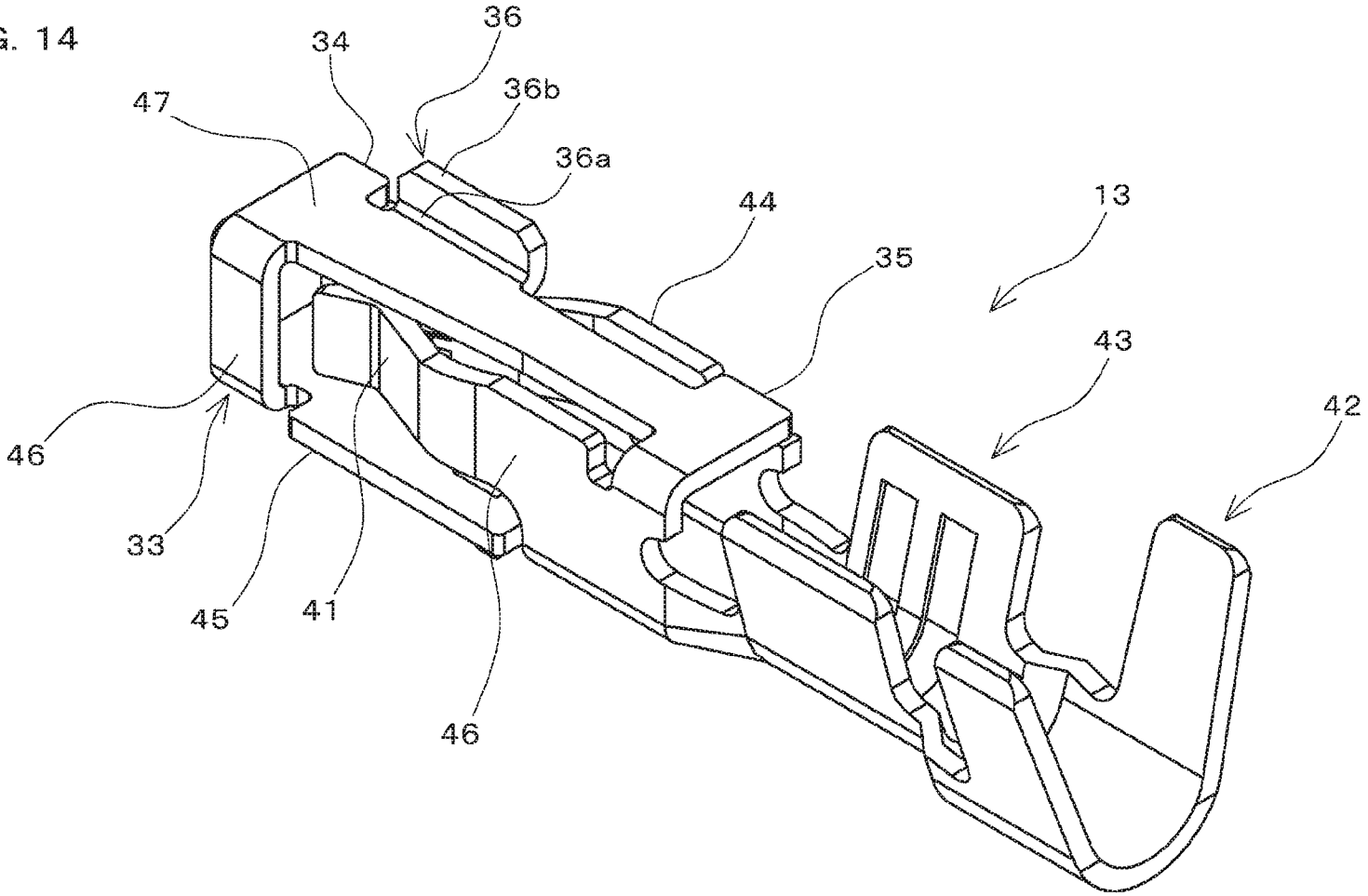
FIG. 14 is a perspective view of the first terminal shown in FIG. 13, from an angle that is different from the angle in FIG. 13.
Figure 15:
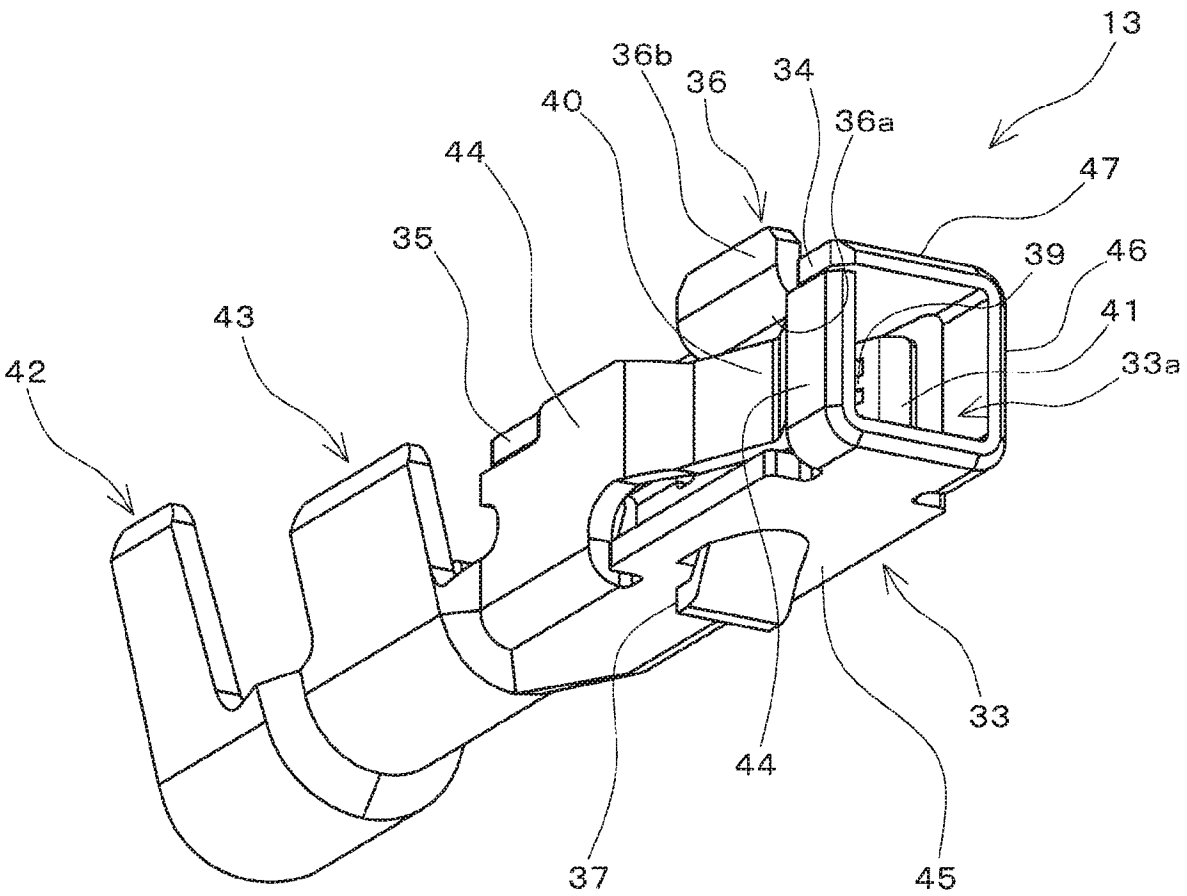
FIG. 15 is a perspective view of the first terminal shown in FIG. 13, from an angle that is different from the angles in FIGS. 13 and 14.
Figure 16:
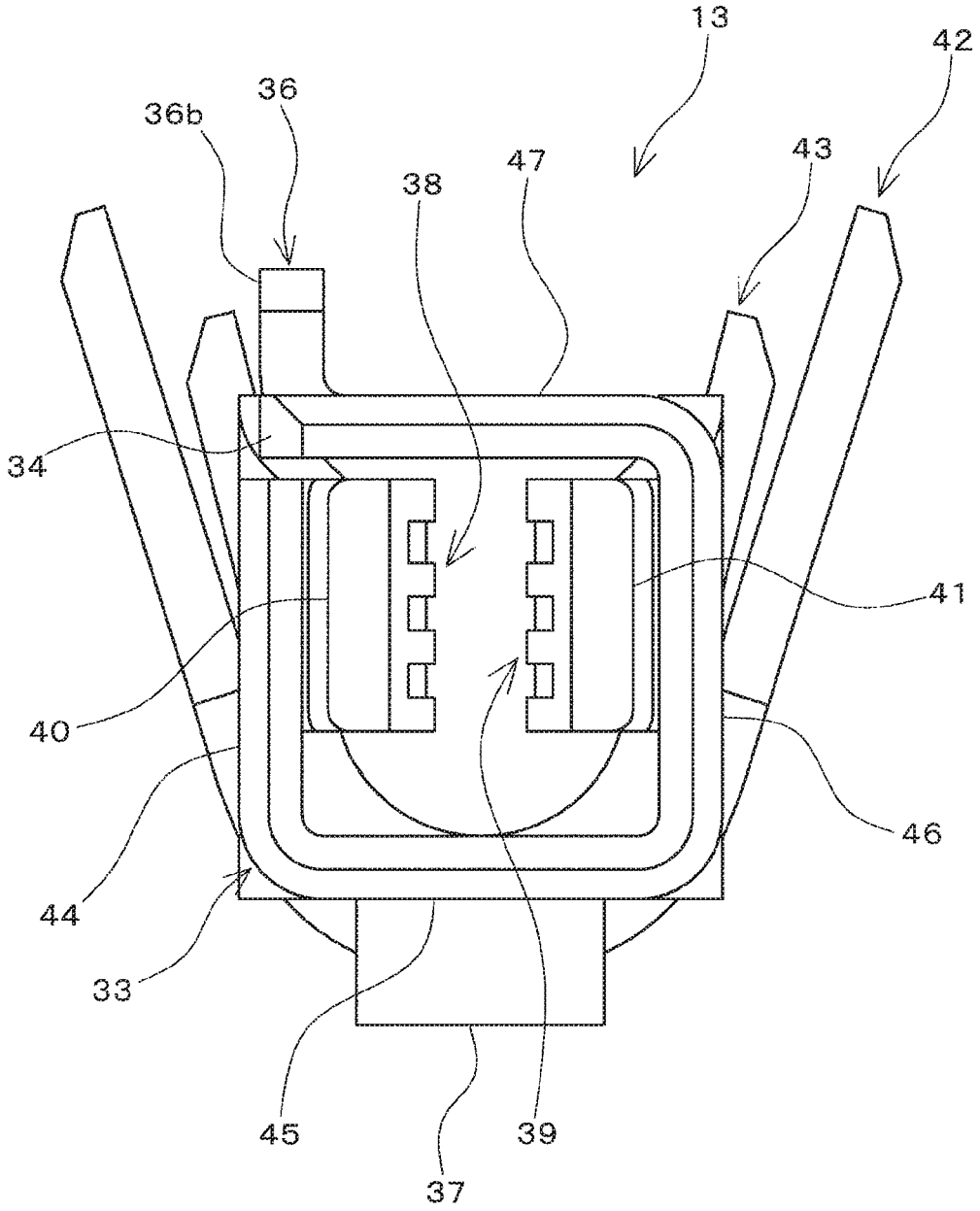
FIG. 16 is a front view of the first terminal shown in FIG. 13.
Figure 17:
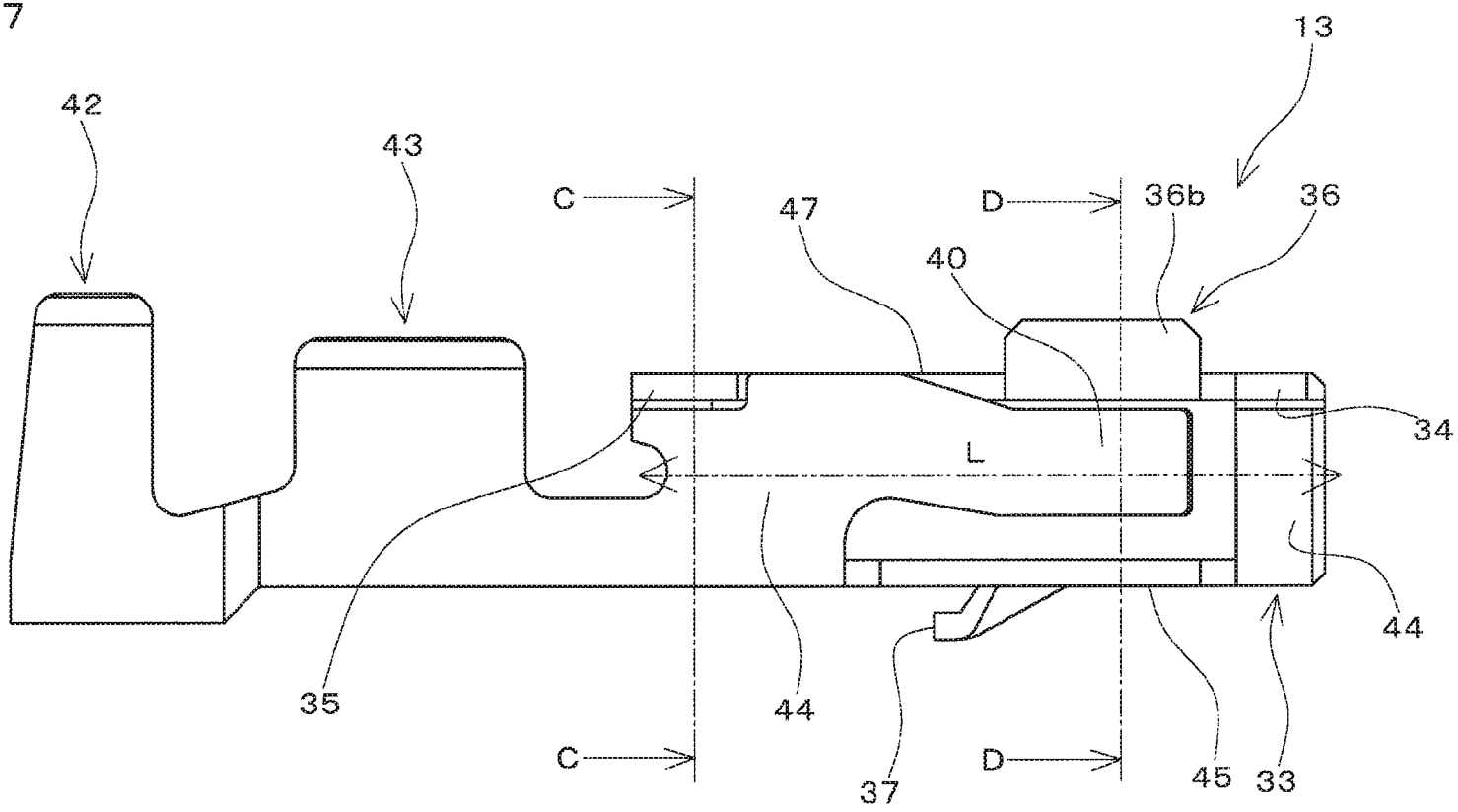
FIG. 17 is a side view of the first terminal shown in FIG. 13.
Figure 18:
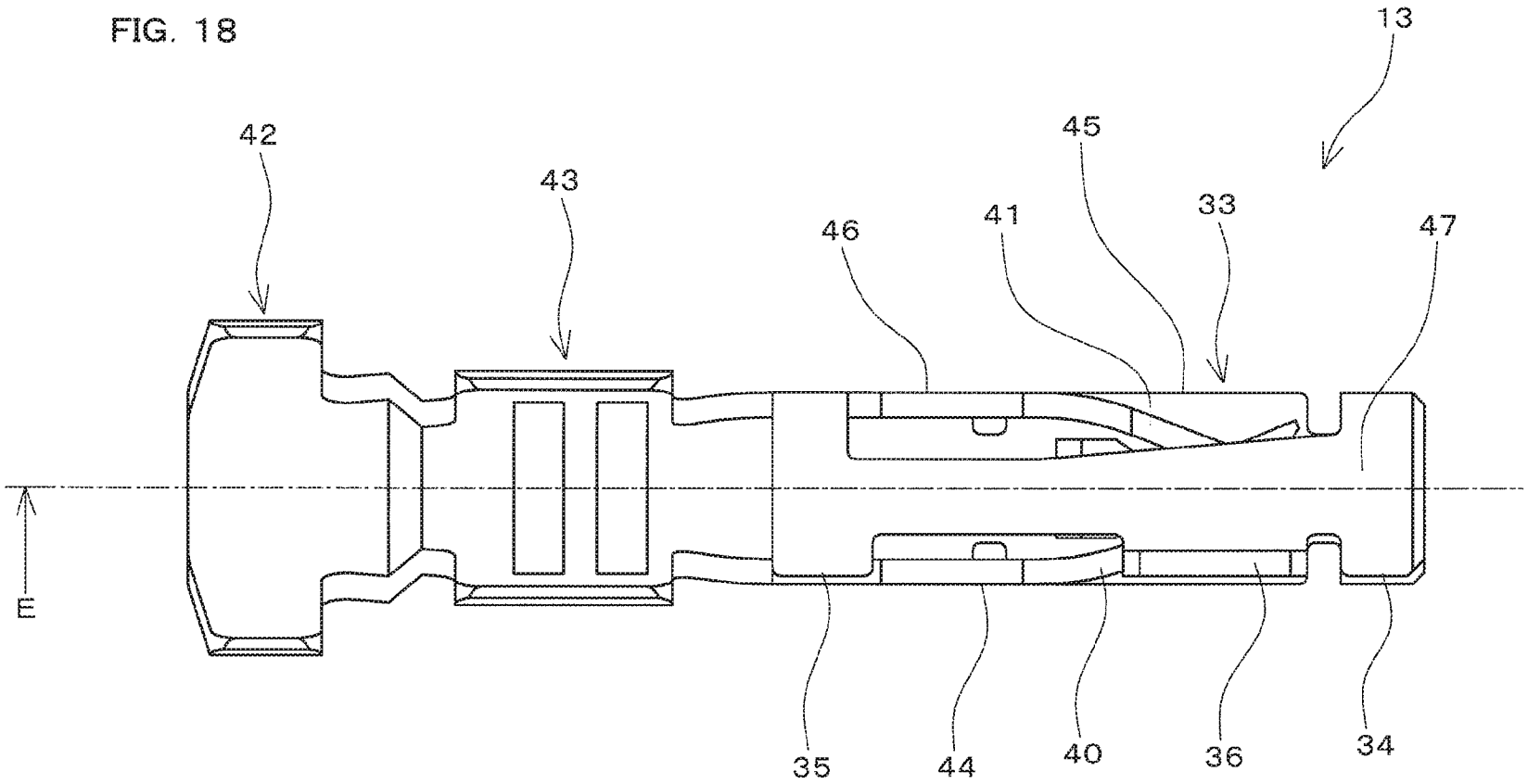
FIG. 18 is a plan view of the first terminal shown in FIG. 13, in which the side surface shown in FIG. 17 is shown as the front surface side.

Next, the first terminals 13 of the first connector 11 of the electrical connection apparatus 1 will be described in further detail. FIG. 13 is a perspective view of a first terminal 13. FIG. 14 is a perspective view of the first terminal 13 from an angle that is different from the angle in FIG. 13. FIG. 15 is a perspective view of the first terminal 13 from an angle that is different from the angles in FIGS. 13 and 14. FIG. 16 is a front view of the first terminal 13. FIG. 17 is a side view of the first terminal 13. FIG. 18 is a plan view of the first terminal 13, in which the side surface shown in FIG. 17 is shown as the front surface side.

The first terminal 13 shown in FIGS. 3 to 5, 7, and 13 to 18 constitutes the terminal 13 according to an embodiment of the present invention, and is configured as a terminal 13 of the connector 11 (first connector 11) in an embodiment of the present invention. Note that in the following description, the first terminal 13 will also be called the terminal 13, the first connector 11 will also be called the connector 11, and the first housing 14 will also be called the housing 14, as previously described.

The terminal 13 is configured as a terminal for the connector 11 that is used in the state of being inserted into the housing 14 of the connector 11. The terminal 13 includes a tubular (tube-like) wall portion 33, abutting portions (34, 35), a projection portion 36, an engaging portion 37, electrical contact portions (38, 39), contact spring portions (40, 41), an electrical wire crimping portion 42, a conductor crimping portion 43, and the like.

As shown in FIGS. 4 and 13 to 18, the tubular wall portion 33 is provided as a rectangular tube-shaped portion of the terminal 13. The tubular wall portion 33 has a longitudinal direction, which is the direction in which the tube shape extends. The longitudinal direction of the tubular wall portion 33 is indicated by a dashed double-dotted line double-headed arrow L in FIG. 17. Note that the longitudinal direction of the tubular wall portion 33 is the same direction as the longitudinal direction of the terminal 13.

Also, the tubular wall portion 33 includes a first side wall portion 44, a bottom wall portion 45 that is integrated with the first side wall portion 44, a second side wall portion 46 that is integrated with the bottom wall portion 45, and an upper wall portion 47 that is integrated with the second side wall portion 46. In other words, the tubular wall portion 33 is provided as a rectangular tube-shaped portion of the terminal 13 that has four wall portions, namely the first side wall portion 44, the bottom wall portion 45, the second side wall portion 46, and the upper wall portion 47. Note that the first side wall portion 44 and the upper wall portion 47 are not integrated with each other, and the first side wall portion 44 and the upper wall portion 47 are provided such that edge portions thereof can partially abut against each other.

When the terminal 13 is inserted into the housing 14 (first housing 14), the tubular wall portion 33 is inserted into a terminal insertion hole 16 of the housing 14 in a direction parallel to the longitudinal direction of the tubular wall portion 33. Also, the tubular wall portion 33 has a terminal insertion opening 33*a* on the leading end side in the insertion direction, which is the direction in which the tubular wall portion 33 is inserted into the housing 14 in parallel with the longitudinal direction of the tubular wall portion 33.

When the connector 11 (first connector 11) and the second connector 12 are to be connected, and the terminal 13 (first terminal 13) and the second terminal 23 are to be connected, the terminal connection portion 25 of the second terminal 23 is inserted into the tubular wall portion 33 of the terminal 13. The terminal 13 and the second terminal 23 are electrically and mechanically connected by the terminal connection portion 25 of the second terminal 23 being mated to the tubular wall portion 33 of the terminal 13. When the second terminal 23 is to be mated to the terminal 13, the terminal connection portion 25 of the second terminal 23 is inserted into the tubular wall portion 33 through the terminal insertion opening 33*a* of the tubular wall portion 33 of the terminal 13 that is open on the leading end side of the tubular wall portion 33.

Figure 19:
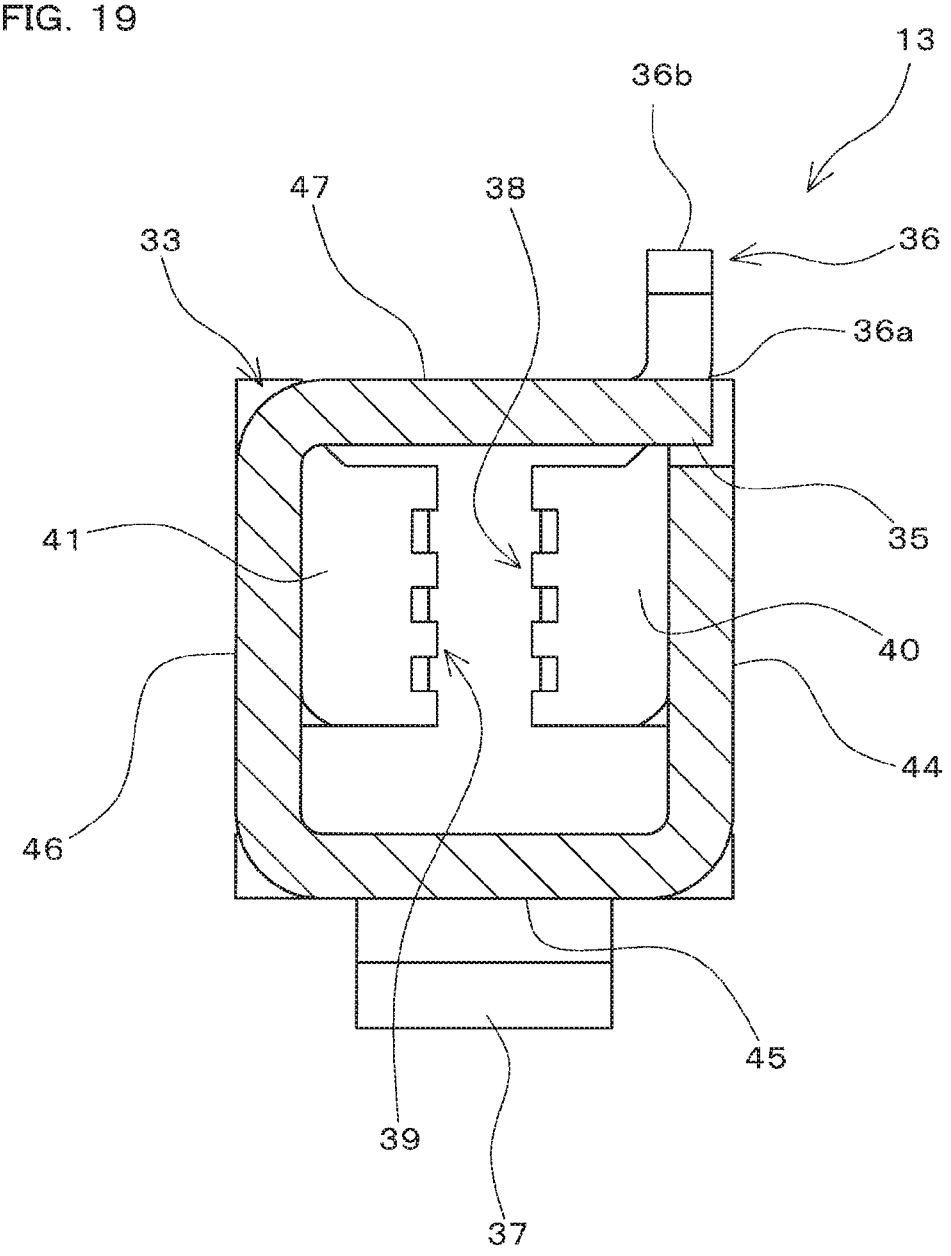
FIG. 19 is a diagram showing a cross-section taken along line C-C in FIG. 17 and viewed in the direction indicated by arrows.
Figure 20:
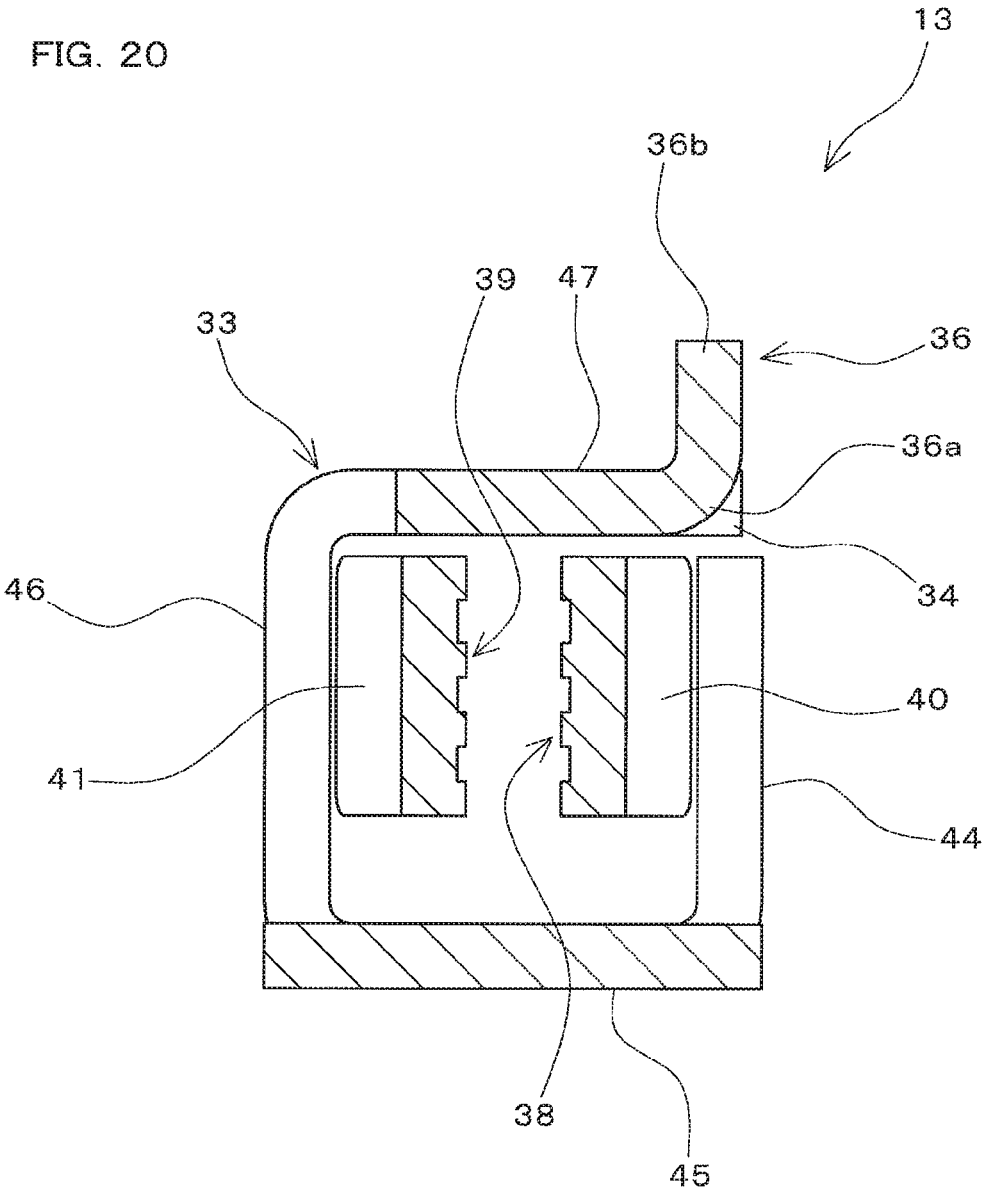
FIG. 20 is a diagram showing a cross-section taken along line D-D in FIG. 17 and viewed in the direction indicated by arrows.

FIG. 19 is a diagram showing a cross-section taken along line C-C in FIG. 17 and viewed in the direction indicated by arrows. FIG. 20 is a diagram showing a cross-section taken along line D-D in FIG. 17 and viewed in the direction indicated by arrows. As shown in FIGS. 13 to 20, multiple abutting portions (34, 35) are provided. The present embodiment illustrates a mode of the terminal 13 in which two abutting portions (34, 35) are provided.

The abutting portions (34, 35) are each provided as a portion of the edge portion of the upper wall portion 47. More specifically the abutting portions (34, 35) are each a portion of the edge portion of the upper wall portion 47, and are each provided as a portion of the edge portion of the upper wall portion 47 that is arranged at a position that opposes an edge portion of the first side wall portion 44 via a gap. Also, the abutting portions (34, 35) are configured to abut against the edge portions of the first side wall portion 44 when the upper wall portion 47 bends toward the inside of the tubular wall portion 33.

Also, the abutting portions (34, 35) are provided at positions on the upper wall portion 47 that are separated from each other in the longitudinal direction of the tubular wall portion 33. The abutting portion 34 is provided in an end portion of the upper wall portion 47 on the leading end side in the direction of insertion of the tubular wall portion 33 into the housing 14 (i.e., on the terminal insertion opening 33*a* side in the longitudinal direction of the tubular wall portion 33). On the other hand, the abutting portion 35 is provided in an end portion of the upper wall portion 47 on the side opposite to the leading end side of the tubular wall portion 33 (i.e., the side opposite to the terminal insertion opening 33*a* side in the longitudinal direction of the tubular wall portion 33).

As shown in FIGS. 13 to 20, the projection portion 36 of the terminal 13 projects from the upper wall portion 47 in the shape of a protrusion or a projection. Furthermore, the projection portion 36 is configured to abut against the housing 14 when the tubular wall portion 33 is inserted into the housing 14 in an orientation different from a predetermined insertion orientation. By abutting against the housing 14 in this way, the projection portion 36 is configured to restrict insertion of the tubular wall portion 33 toward the back of the housing 14 in an orientation different from a predetermined insertion orientation. In other words, the projection portion 36 is provided in the terminal 13 as an erroneous attachment prevention portion for preventing erroneous attachment of the terminal 13 to the housing 14.

Also, the projection portion 36 protrudes from an edge portion of the upper wall portion 47 in the present embodiment. More specifically, the projection portion 36 has a bent portion 36*a* and a projecting end portion 36*b*. The bent portion 36*a* is integrated with a portion of the edge portion of the upper wall portion 47, and is provided as a portion that extends while bending relative to the upper wall portion 47. The projecting end portion 36*b* is provided as a portion that projects and extends from the bent portion 36*a* in a cantilevered manner. The projecting end portion 36*b* is provided in a manner of projecting from the upper wall portion 47 along a direction approximately perpendicular to the planar direction in which the upper wall portion 47 extends. Furthermore, the projection portion 36 is provided on the leading end side of the tubular wall portion 33 in the direction of insertion of the tubular wall portion 33 into the housing 14.

The projection portion 36 is configured to be fitted into and slide in an insertion orientation restriction groove 18 of the housing 14 when the tubular wall portion 33 is inserted into a terminal insertion hole 16 of the housing 14 in a predetermined insertion orientation. When the tubular wall portion 33 is inserted into the terminal insertion hole 16 of the housing 14 in the predetermined insertion orientation, the terminal 13 is properly fitted into the housing 14 and inserted to the back thereof. Accordingly, the aforementioned predetermined insertion orientation for properly fitting the terminal 13 to the back of the housing 14 is configured as an orientation in which the tubular wall portion 33 is inserted into the terminal insertion hole 16 of the housing 14 such that the projection portion 36 is fitted into and slides in the insertion orientation restriction groove 18.

If the tubular wall portion 33 is inserted into the terminal insertion hole 16 of the housing 14 in an orientation different from the predetermined insertion orientation, the projection portion 36 abuts against the edge portion of the opening of the terminal insertion hole 16 in the housing 14. In other words, the projection portion 36 abuts against a portion of the edge portion of the terminal insertion hole 16 that is different from the portion where the insertion orientation restriction groove 18 is provided. Accordingly, if the tubular wall portion 33 is inserted into the terminal insertion hole 16 of the housing 14 in an orientation different from the predetermined insertion orientation, the projection portion 36 abuts against the edge portion of the terminal insertion hole 16, thus restricting insertion of the tubular wall portion 33 toward the back of the housing 14. In other words, erroneous attachment of the terminal 13 to the housing 14 is prevented.

Note that the projection portion 36 that protrudes from the edge portion of the upper wall portion 47 is arranged adjacent to the abutting portion 34 via a notch portion 48 in the edge portion of the upper wall portion 47. In other words, the notch portion 48 is provided between the abutting portion 34 and the projection portion 36 in the edge portion of the upper wall portion 47. Also, the abutting portion 34 and the projection portion 36 are arranged on the edge portion of the upper wall portion 47 via a gap therebetween that is defined by the notch portion 48 formed with a receding shape. In this way, by providing the notch portion 48 between the abutting portion 34 and the projection portion 36 in the edge portion of the upper wall portion 47, it is possible to suppress the case where external force applied to one of these two causes excessive stress to also be applied to the other one. In other words, by providing the notch portion 48, it is possible to suppress the case where external force applied to one of the abutting portion 34 and the projection portion 36 causes excessive stress to also be applied to the other one of the abutting portion 34 and the projection portion 36 to which external force was not directly applied.

Figure 21:
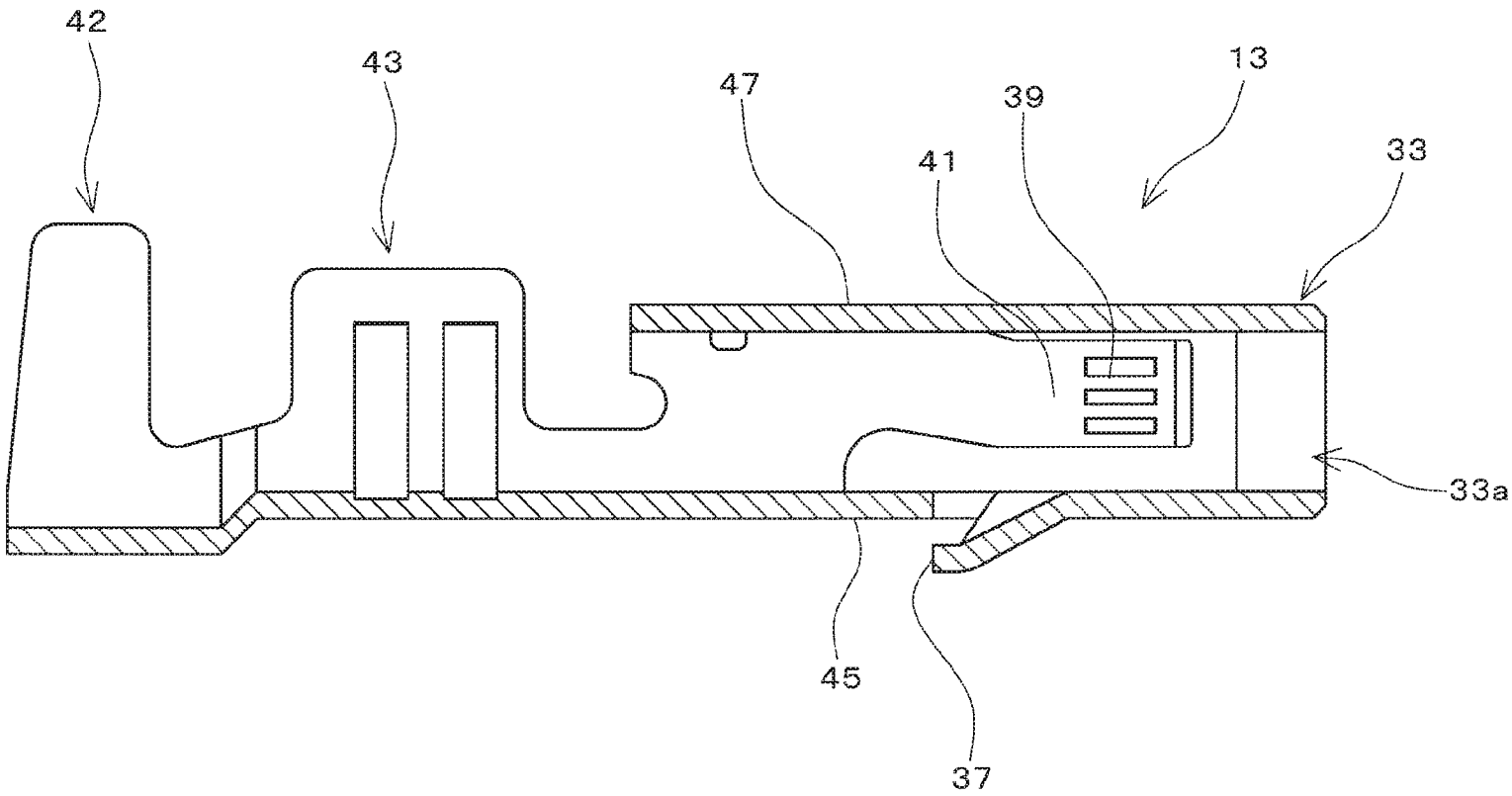
FIG. 21 is a diagram showing a cross-section taken along line E-E in FIG. 18 and viewed in the direction indicated by arrows.

FIG. 21 is a diagram showing a cross-section taken along line E-E in FIG. 18 and viewed in the direction indicated by arrows. As shown in FIGS. 4, 13, 15 to 17, 19, and 21, the engaging portion 37 is provided on the tubular wall portion 33, and is provided on the bottom wall portion 45 of the tubular wall portion 33 in the present embodiment. Also, the engaging portion 37 is configured to be capable of engaging with an engaged portion 17 provided inside the housing 14 when the tubular wall portion 33 is inserted into the housing 14 in the above-described predetermined insertion orientation.

In the present embodiment, the engaging portion 37 is formed by cutting and bending a portion of the bottom wall portion 45 toward the outside of the tubular wall portion 33, and is provided as a portion that projects outward from the bottom wall portion 45. Furthermore, the engaging portion 37 projects outward from the bottom wall portion 45 in a direction from the leading end side in the direction of insertion of the tubular wall portion 33 into the housing 14 toward the opposite side in this insertion direction, and also in a direction oblique to the longitudinal direction of the tubular wall portion 33. Accordingly, when the tubular wall portion 33 is inserted into the terminal insertion hole 16 of the housing 14 in the predetermined insertion orientation, the engaging portion 37 and the engaged portion 17 reliably engage with each other, thus preventing the tubular wall portion 33 from coming out of the terminal insertion hole 16. In other words, even if external force in the direction of removal from the terminal insertion hole 16 is applied to the tubular wall portion 33, the leading end portion of the engaging portion 37 is fitted into and reliably engaged with the recession portion 17*a* of the engaged portion 17, thus preventing the tubular wall portion 33 from coming out of the terminal insertion hole 16.

Also, the engaging portion 37 of the terminal 13 and the engaged portion 17 of the housing 14 are configured such that when the tubular wall portion 33 is inserted into the housing 14 in the above-described predetermined insertion orientation, the engaging portion 37 and the engaged portion 17 can engage with each other by one of them abutting against the other one, elastically deforming, and then undergoing elastic recovery. Note that the engaging portion 37 and the engaged portion 17 of the present embodiment are configured such that when the tubular wall portion 33 is inserted into the housing 14 in the predetermined insertion orientation, the engaging portion 37 and the engaged portion 17 can engage with each other by the engaged portion 17 abutting against the engaging portion 37, elastically deforming, and then undergoing elastic recovery. In other words, in the present embodiment, when the tubular wall portion 33 is inserted into the terminal insertion hole 16 in the predetermined insertion orientation, the engaged portion 17 abuts against the engaging portion 37 and elastically deforms by temporarily bending so as to ride over the engaging portion 37. Then, when the tubular wall portion 33 has been inserted to the back of the terminal insertion hole 16, the engaged portion 17 undergoes elastic recovery and the leading end portion of the engaging portion 37 is maintained in the state of being located at a position of being able to be fitted into and engaged with the recession portion 17*a* of the engaged portion 17.

Also, the engaging portion 37 is provided at a position on the tubular wall portion 33 that is shifted from or separated from the projection portion 36 in the longitudinal direction of the tubular wall portion 33 (see FIG. 17). In the present embodiment, the projection portion 36 is provided on the tubular wall portion 33 at a position on the leading end side relative to the engaging portion 37 in the direction of insertion of the tubular wall portion 33 into the housing 14. The engaging portion 37 is provided on the tubular wall portion 33 at a position that is shifted from or separated from the projection portion 36 in the direction opposite to the insertion direction.

As shown in FIGS. 5, 15, 16, and 19 to 21, the electrical contact portions (38, 39) are provided inside the tubular wall portion 33. The electrical contact portions (38, 39) are configured as portions that are electrically connected to the terminal connection portion 25 of the second terminal 23 when the terminal connection portion 25 is inserted into the tubular wall portion 33. In the present embodiment, a pair of electrical contact portions (38, 39) are provided, and these electrical contact portions come into contact with the terminal connection portion 25 in a manner of sandwiching side surfaces of the terminal connection portion 25 on respective sides thereof when the terminal connection portion 25 is mated to the tubular wall portion 33. Accordingly, the electrical contact portions (38, 39) and the terminal connection portion 25 are electrically connected to each other, and the terminal 13 and the second terminal 23 are electrically connected to each other.

As shown in FIGS. 5 and 13 to 21, a pair of contact spring portions (40, 41) are provided. The pair of contact spring portions (40, 41) are respectively provided as a portion of the first side wall portion 44 and a portion of the second side wall portion 46, and are each a plate spring-shaped portion that extends in a cantilevered manner. More specifically, the contact spring portion 40 is provided as a portion of the first side wall portion 44, and is provided as a plate spring-shaped portion that extends in a cantilevered manner along the longitudinal direction of the tubular wall portion 33. Also, the contact spring portion 41 is provided as a portion of the second side wall portion 46, and is provided as a plate spring-shaped portion that extends in a cantilevered manner along the longitudinal direction of the tubular wall portion 33.

As described above, the contact spring portion 40, which is a portion of the first side wall portion 44, extends in a cantilevered manner along the longitudinal direction of the tubular wall portion 33. For this reason, out of the edge portions of the contact spring portion 40 on the two sides that extend along the longitudinal direction of the tubular wall portion 33, one opposes an edge portion of the bottom wall portion 45 via a gap, and the other opposes an edge portion of the upper wall portion 47 via a gap.

Also, the contact spring portion 41, which is a portion of the second side wall portion 46, extends in a cantilevered manner along the longitudinal direction of the tubular wall portion 33. For this reason, out of the edge portions of the contact spring portion 41 on the two sides that extend along the longitudinal direction of the tubular wall portion 33, one opposes an edge portion of the bottom wall portion 45 via a gap, and the other opposes an edge portion of the upper wall portion 47 via a gap.

Also, the contact spring portions (40, 41) are arranged inward of the edge portions of the upper wall portion 47 with respect to the width direction of the tubular wall portion 33. More specifically the contact spring portion 40 has a portion that is bent inward in the width direction of the tubular wall portion 33, and is arranged inward, with respect to the width direction of the tubular wall portion 33, of the edge of the upper wall portion 47 on the first side wall portion 44 side. Also, the contact spring portion 41 has a portion that is bent inward in the width direction of the tubular wall portion 33, and is arranged inward, with respect to the width direction of the tubular wall portion 33, of the edge of the upper wall portion 47 on the second side wall portion 46 side. Note that the width direction of the tubular wall portion 33 is a direction that is perpendicular to the longitudinal direction of the tubular wall portion 33, and is the direction in which the first side wall portion 44 and the second side wall portion 46 oppose each other.

Also, in the present embodiment, the electrical contact portions (38, 39) are respectively provided on the leading end sides of the pair of contact spring portions (40, 41) that extend in a cantilevered manner. Note that the electrical contact portion 38 is provided on the inward side of the leading end side of the contact spring portion 40. Also, the electrical contact portion 39 is provided on the inward side of the leading end side of the contact spring portion 41.

As shown in FIGS. 4, 5, 13 to 18, and 21, the terminal 13 is provided with the electrical wire crimping portion 42 and the conductor crimping portion 43 as portions that are attached and fixed by being crimped to an end portion of an electrical wire 101. The electrical wire crimping portion 42 is provided as a portion that is attached and fixed by being crimped to the end portion of the electrical wire 101 from outside of a covering portion 101*a*. The electrical wire crimping portion 42 has a pair of claw portions that are bent in order to be crimped to the end portion of the electrical wire 101. The conductor crimping portion 43 is provided as a portion that is attached and fixed by being crimped to a portion of the end portion of the electrical wire 101 in which the covering portion 101*a* has been removed to expose a conductor 101*b*. The conductor crimping portion 43 has a pair of claw portions that are bent in order to be crimped to the end portion of the electrical wire 101. The terminal 13 is electrically and mechanically connected to the electrical wire 101 by the conductor crimping portion 43 being attached to the conductor 101*b* in the end portion of the electrical wire 101. Also, the terminal 13 is mechanically connected to the electrical wire 101 more robustly by the electrical wire crimping portion 42 being attached to the end portion of the electrical wire 101.

Actions and Effects of Present Embodiment

When the tubular wall portion 33 of the terminal 13 of the present embodiment is inserted into the housing 14 of the connector 11 in an orientation different from the predetermined insertion orientation, the projection portion 36 abuts against the housing 14, thus restricting insertion of the tubular wall portion 33 toward the back of the housing 14. Accordingly, erroneous attachment of the terminal 13 to the housing 14 is prevented. In other words, in the terminal 13, the projection portion 36 is provided as an erroneous attachment prevention portion for preventing erroneous attachment of the terminal 13 to the housing 14.

Also, the terminal 13 of the present embodiment is provided with the engaging portion 37 that can engage with the engaged portion 17 inside the housing 14 when the terminal 13 is inserted into the housing 14 in the predetermined insertion orientation. The engaging portion 37 and the engaged portion 17 can engage with each other by one of them abutting against the other one, elastically deforming, and then undergoing elastic recovery. Due to the above-described engagement of the engaging portion 37 of the terminal 13 to the housing 14, when the terminal 13 is inserted into the housing 14, the terminal 13 is prevented from coming out of and being withdrawn from the housing 14. In other words, in the terminal 13, the engaging portion 37 is provided as a withdrawal prevention portion for preventing the terminal 13 from being withdrawn from the housing 14.

Furthermore, in the terminal 13 of the present embodiment, the engaging portion 37 is provided at a position on the tubular wall portion 33 that is shifted from or separated from the projection portion 36 in the longitudinal direction. For this reason, according to the terminal 13 of the present embodiment, the projection portion 36 serving as the erroneous attachment prevention portion and the engaging portion 37 serving as the withdrawal prevention portion are provided in a state of being shifted or separated and independent in the longitudinal direction of the tubular wall portion 33. Thus, according to the terminal 13 of the present embodiment, it is possible to suppress the case where the projection portion 36 serving as the erroneous attachment prevention portion and the engaging portion 37 serving as the withdrawal prevention portion are constrained by the positions of one another.

Also, according to the terminal 13 of the present embodiment, the tubular wall portion 33 is constituted by integrally providing the first side wall portion 44, the bottom wall portion 45, the second side wall portion 46, and the upper wall portion 47 in the stated order, and thus is constituted with a simple structure. Furthermore, in the terminal 13 of the present embodiment, the projection portion 36 serving as the erroneous attachment prevention portion is constituted with a simple structure of projecting from the upper wall portion 47 in the shape of a protrusion or a projection. Also, according to the terminal 13 of the present embodiment, portions of the edge portion of the upper wall portion 47 are constituted as abutting portions (34, 35) that abut against the edge portion of the first side wall portion 44 when the upper wall portion 47 bends toward the inside of the tubular wall portion 33. For this reason, even in the case where the terminal 13 is inserted into the housing 14 in an orientation different from the predetermined insertion orientation, the projection portion 36 abuts against the housing 14, and the upper wall portion 47 provided with the projection portion 36 bends toward the inside of the tubular wall portion 33, the abutting portions (34, 35) abut against the edge portion of the first side wall portion 44, thus preventing the upper wall portion 47 from collapsing into the interior of the tubular wall portion 33. Accordingly, the projection portion 36 is maintained in a state of abutting against the housing 14, and appropriate operation of the projection portion 36 serving as the erroneous attachment prevention portion is ensured. Also, according to the terminal 13 of the present embodiment, the structure for ensuring appropriate operation of the projection portion 36 serving as the erroneous attachment prevention portion is realized by a simple structure including the tubular wall portion 33 that has a simple structure, the projection portion 36 that has a simple structure, and the abutting portions (34, 35) that have a simple structure, are provided as portions of the edge portion of the upper wall portion 47, and abut against the edge portion of the first side wall portion 44. Thus, according to the terminal 13 of the present embodiment, it is possible to use a simple structure to ensure appropriate operation of the erroneous attachment prevention portion.

As described above, according to the present embodiment, it is possible to provide a terminal 13 that can suppress the case in which the position of an erroneous attachment prevention portion, which is for preventing erroneous attachment of the terminal 13 to the housing 14, and the position of a withdrawal prevention portion, which is for preventing the terminal 13 from being withdrawn from the housing 14, are constrained by the positions of one another, and that enables realizing a simple structure for ensuring appropriate operation of the erroneous attachment prevention portion.

Also, according to the present embodiment, the projection portion 36 is provided on the leading end side in the direction of insertion of the terminal 13 into the housing 14.

For this reason, when the terminal 13 is inserted into the housing 14 in an orientation different from the predetermined insertion orientation, the projection portion 36 abuts against the edge portion of the opening of the terminal insertion hole 16, which is the hole of the housing 14 into which the terminal 13 is inserted, and most of the portion of the terminal 13 other than the portion on the leading end side of the tubular wall portion 33 is exposed from the housing 14. Accordingly the erroneous attachment state, in which the terminal 13 has been inserted into the housing 14 in an orientation different from the predetermined insertion orientation, is shown more clearly. Therefore, the operator who is performing the operation of inserting the terminal 13 into the housing 14 can quickly and easily see and recognize that erroneous attachment has occurred.

Furthermore, according to the present embodiment, the engaging portion 37 is provided on the tubular wall portion 33 at a position that is shifted from or separated from the projection portion 36 in the direction opposite to the direction of insertion of the terminal 13 into the housing 14. For this reason, the position of the engaging portion 37 serving as the withdrawal prevention portion is set to a position that is shifted or separated to the side opposite to the leading end side of the terminal 13, thus suppressing the case where this position is constrained by the position of the projection portion 36 provided on the leading end side of the terminal 13. Also, due to the position of the engaging portion 37 being set to a position that is shifted from or separated from the leading end side of the terminal 13, the engaging portion 37 can be provided in a portion that has higher rigidity in the tubular wall portion 33. Accordingly, an engaging portion 37 having higher rigidity can be constituted easily.

Also, according to the present embodiment, the projection portion 36 is constituted with a simple structure including the bent portion 36*a* that is integrated with a portion of the edge portion of the upper wall portion 47, and the projecting end portion 36*b* that extends from the bent portion 36*a* in a cantilevered manner. Accordingly, the projection portion 36 can be realized with an even simpler structure.

Also, according to the present embodiment, the pair of contact spring portions (40, 41) respectively provided with the electrical contact portions (38, 39) are constituted as a portion of the first side wall portion 44 and a portion of the second side wall portion 46. For this reason, a portion of the first side wall portion 44 and a portion of the second side wall portion 46 can be caused to function as the pair of contact spring portions (40, 41), and the pair of contact spring portions (40, 41) can be realized with a simple structure. Furthermore, the pair of contact spring portions (40, 41), which are provided as plate spring-shaped portions that extend in a cantilevered manner, and are provided with the electrical contact portions (38, 39) on the leading end side, are constituted as a portion of the first side wall portion 44 or the second side wall portion 46. According to this configuration, it is possible to easily set a long length for the arm length from the base portions of the plate springs, which extend in a cantilevered manner, to the electrical contact portions (38, 39) on the leading end side. Also, the pair of contact spring portions (40, 41) are provided in the first side wall portion 44 and the second side wall portion 46, and are not provided on the upper wall portion 47, thus making it possible to suppress the case of influencing the strength of the upper wall portion 47, which is the portion on which the projection portion 36 is provided.

Also, according to the present embodiment, the contact spring portions (40, 41), which are provided as portions of the first and second side wall portions (44, 46) respectively, are arranged inward of the edge portions of the upper wall portion 47 in the width direction of the tubular wall portion 33. For this reason, even if the terminal 13 comes into contact with an outside object, it is possible to effectively suppress the case where the outside object comes into contact with and applies external force to the contact spring portions (40, 41) and deforms or breaks the contact spring portions (40, 41). In particular, when multiple terminals 13 are conveyed in a collective manner, it is possible to effectively suppress the case where another terminal 13 comes into contact with and applies external force to the contact spring portions (40, 41) and deforms or breaks the contact spring portions (40, 41).

Also, according to the present embodiment, multiple abutting portions (34, 35) are provided as portions of the edge portion of the upper wall portion 47. Furthermore, the abutting portions (34, 35) are provided at positions that are separated from each other in the longitudinal direction of the tubular wall portion 33. For this reason, even in the case where the terminal 13 is inserted into the housing 14 in an orientation different from the predetermined insertion orientation, the projection portion 36 abuts against the housing 14, and the upper wall portion 47 provided with the projection portion 36 bends toward the inside of the tubular wall portion 33, the abutting portions (34, 35) that are separated from each other abut against the edge portion of the first side wall portion 44. This therefore more reliably prevents the upper wall portion 47 from collapsing into the interior of the tubular wall portion 33. Also, the projection portion 36 can be more reliably maintained in a state of abutting against the housing 14, and appropriate operation of the projection portion 36 serving as the erroneous attachment prevention portion can be more reliably ensured.

Also, effects similar to those of the terminal 13 can be achieved by the connector 11 of the present embodiment. In other words, according to the present embodiment, it is possible to provide the connector 11 that includes the terminal 13 that can suppress the case in which the positions of the erroneous attachment prevention portion and the withdrawal prevention portion are constrained by the positions of one another, and that realizes a simple structure for ensuring appropriate operation of the erroneous attachment prevention portion. Also, according to the present embodiment, in the housing 14 of the connector 11 as well, the position of the engaged portion 17 that is engaged to the engaging portion 37 of the terminal 13 and the position of the insertion orientation restriction groove 18, which is the portion that corresponds to the projection portion 36 of the terminal 13, can be set to independent positions. For this reason, in the housing 14 of the connector 11 as well, it is possible to suppress the case where the position of the engaged portion 17 that is engaged to the engaging portion 37 of the terminal 13 and the position of the portion that corresponds to the projection portion 36 of the terminal 13 are constrained by the positions of one another. Furthermore, this makes it possible to improve the degree of freedom in the design of the connector 11.

Also, effects similar to those of the terminal 13 can be achieved by the electrical connection apparatus 1 of the present embodiment. In other words, according to the present embodiment, it is possible to provide the electrical connection apparatus 1 that includes the terminal 13 that can suppress the case in which the positions of the erroneous attachment prevention portion and the withdrawal prevention portion are constrained by the positions of one another, and that realizes a simple structure for ensuring appropriate operation of the erroneous attachment prevention portion.

Also, according to the present embodiment, the flat surface 31 faces the outside through the opening 28*a* of the mating portion 28 of the second housing 24 on the inner side of the mating portion 28 of the second housing 24 of the second connector 12, and extends in a flat manner along the direction perpendicular to the direction in which the first housing 14 of the first connector 11 is inserted. For this reason, when the second connector 12 is suctioned and conveyed by a conveying suction apparatus for mounting to the substrate 100, the second connector 12 can be easily suctioned on the flat surface 31. Furthermore, the second connector 12 can be held in a stable state by the conveying suction apparatus. Accordingly, the second connector 12 can be easily mounted to the substrate 100. Also, as previously described, the first connector 11 of the electrical connection apparatus 1 makes it possible to improve the degree of freedom in design. Therefore, according to the electrical connection apparatus 1 of the present embodiment, it is possible to improve the degree of freedom in the design of the first connector 11, and the second connector 12 can be easily mounted to the substrate 100.

Variations

Although an embodiment of the present invention has been described above, the present invention is not limited to the above-described embodiment, and various modifications can be made without departing from the description of the claims. In other words, the present invention is not limited to the above embodiment, and all modifications, applications, and equivalents thereof that fall within the claims, for which modifications and applications would become naturally apparent by reading and understanding the present specification, are intended to be embraced in the claims of the invention. For example, modifications such as the following may be made.

Figure 22:
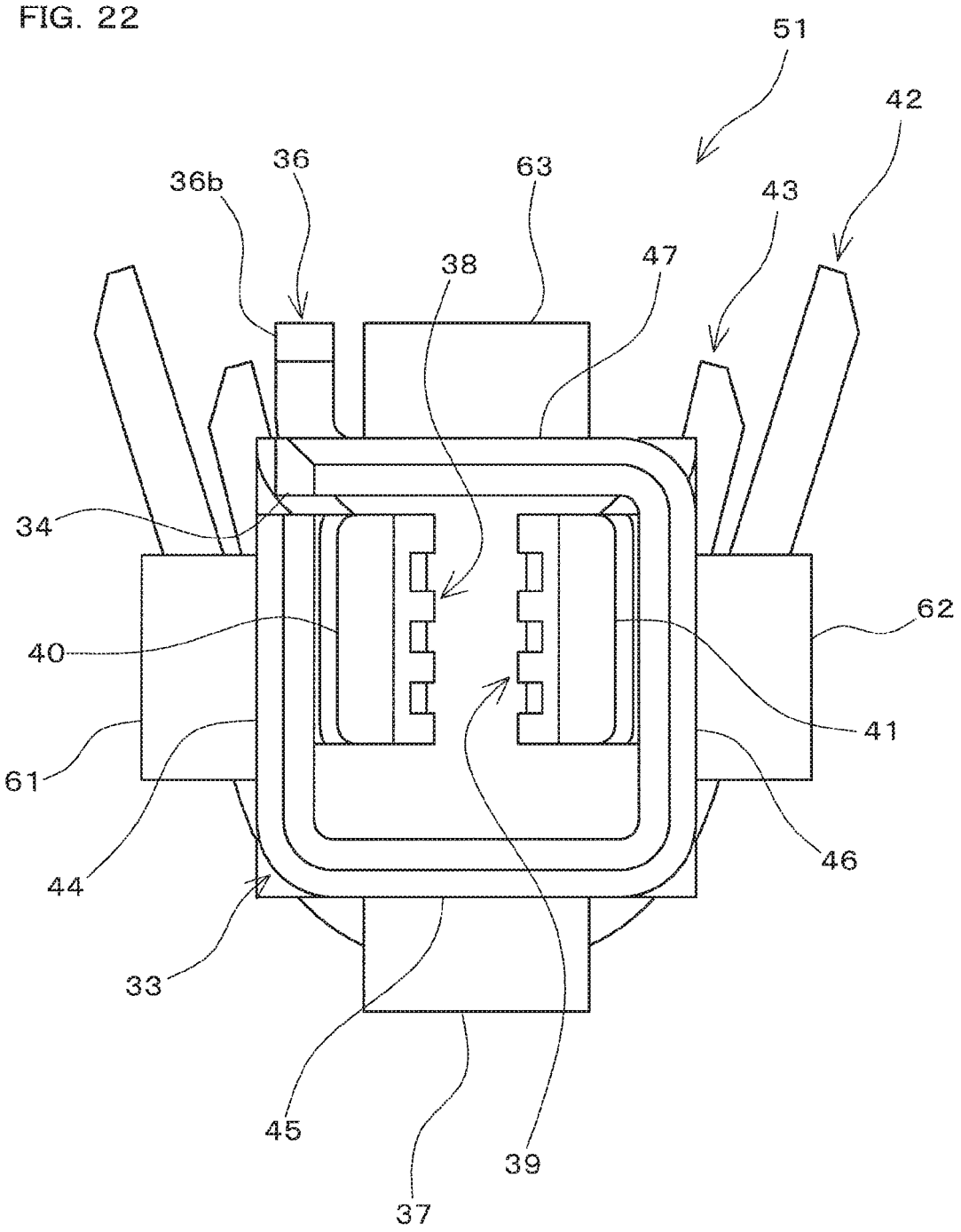
FIG. 22 is a front view of a terminal according to a first variation.

(1) FIG. 22 is a front view of a terminal 51 according to a first variation. The terminal 51 according to the first variation has a similar configuration to the terminal 13 of the above embodiment, but is different from the terminal 13 of the above embodiment with respect to the configuration of engaging portions (37, 61, 62, 63). The following describes only configurations of the terminal 51 of the first variation that are different from the terminal 13 of the above embodiment. Also, redundant descriptions of elements having a configuration similar to the above embodiment will be appropriately omitted by assigning the same reference signs in the drawings or citing the descriptions of such elements given in the above embodiment.

Although the terminal 13 is provided with only one engaging portion 37, the terminal 51 is provided with multiple engaging portions (37, 61, 62, 63) as shown in FIG. 22. Note that FIG. 22 shows an example of a mode in which the terminal 51 is provided with four engaging portions (37, 61, 62, 63).

The engaging portion 37 is configured similarly to the engaging portion 37 of the terminal 13, and is provided on the bottom wall portion 45. The engaging portion 61 is configured similarly to the engaging portion 37 of the terminal 13, and is provided on the first side wall portion 44. The engaging portion 62 is configured similarly to the engaging portion 37 of the terminal 13, and is provided on the second side wall portion 46. The engaging portion 63 is configured similarly to the engaging portion 37 of the terminal 13, and is provided on the upper wall portion 47.

The engaging portions (37, 61, 62, 63) are each provided in the tubular wall portion 33, and are configured to be able to engage with engaged portions (not shown) provided inside the housing (not shown) that is to hold the terminal 51 when the tubular wall portion 33 is inserted into the housing in a predetermined insertion orientation.

A mode is possible in which multiple engaging portions (37, 61, 62, 63) are provided, as with the terminal 51 of the first variation. Also, the number of engaging portions and the positions thereof are not limited to the examples of the terminal 13 and the terminal 51, and may be modified in various ways. In other words, a mode is possible in which the terminal is provided with two, three, or five or more engaging portions. Also, the position where the engaging portion is provided need only be a position on the tubular wall portion, and may be a position on at least any one of the first side wall portion, the bottom wall portion, the second side wall portion, and the upper wall portion. Also, a connector including the terminal of the above variation is also encompassed in the present invention. Furthermore, an electrical connection apparatus including the terminal of the above variation is also encompassed in the present invention.

Figure 23:
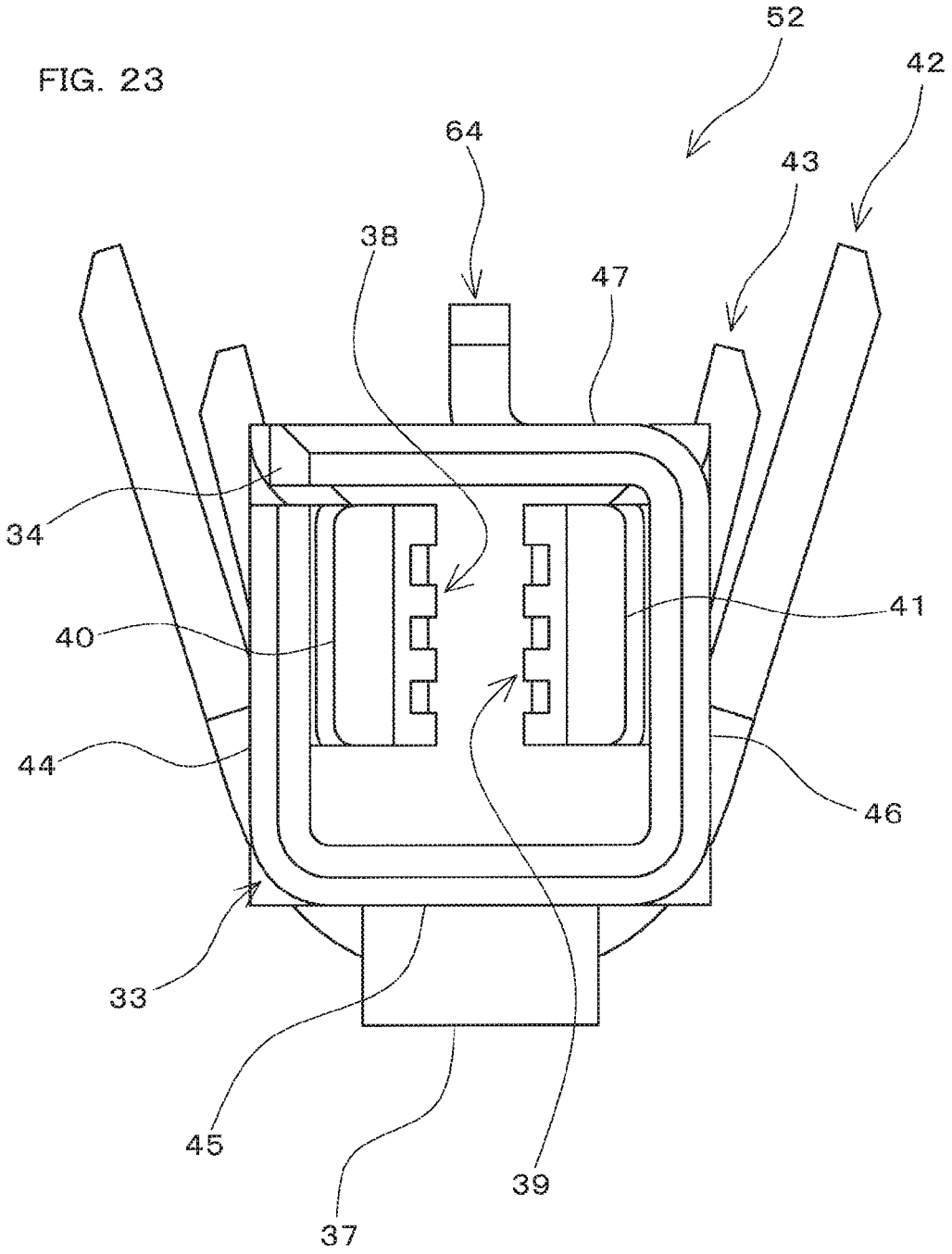
FIG. 23 is a front view of a terminal according to a second variation.

(2) FIG. 23 is a front view of a terminal 52 according to a second variation. The terminal 52 according to the second variation has a similar configuration to the terminal 13 of the above embodiment, but is different from the terminal 13 of the above embodiment with respect to the configuration of the projection portion 64. The following describes only configurations of the terminal 52 of the second variation that are different from the terminal 13 of the above embodiment. Also, redundant descriptions of elements having a configuration similar to the above embodiment will be appropriately omitted by assigning the same reference signs in the drawings or citing the descriptions of such elements given in the above embodiment.

Although the projection portion 36 of the terminal 13 is provided on an edge portion of the upper wall portion 47, the projection portion 64 of the terminal 52 is provided in the central portion, with respect to the width direction, of the upper wall portion 47 as shown in FIG. 23. Note that the width direction of the upper wall portion 47 is the same direction as the width direction of the tubular wall portion 33.

The projection portion 64 protrudes from the central portion in the width direction of the upper wall portion 47 in the shape of protrusion or a projection. Furthermore, the projection portion 64 is configured to abut against the housing (not shown) that is to hold the terminal 52 when the tubular wall portion 33 is inserted into the housing in an orientation different from a predetermined insertion orientation. By abutting against the housing in this way, the projection portion 64 is configured to restrict insertion of the tubular wall portion 33 toward the back of the housing in an orientation different from a predetermined insertion orientation.

A mode is possible in which the projection portion 64 is provided on a portion other than an edge portion of the upper wall portion 47, as with the terminal 52 of the second variation. Also, the number of projection portions and the positions thereof on the upper wall portion are not limited to the examples of the terminal 13 and the terminal 52, and may be modified in various ways. Also, a connector including the terminal of the above variation is also encompassed in the present invention. Furthermore, an electrical connection apparatus including the terminal of the above variation is also encompassed in the present invention.

Figure 24:
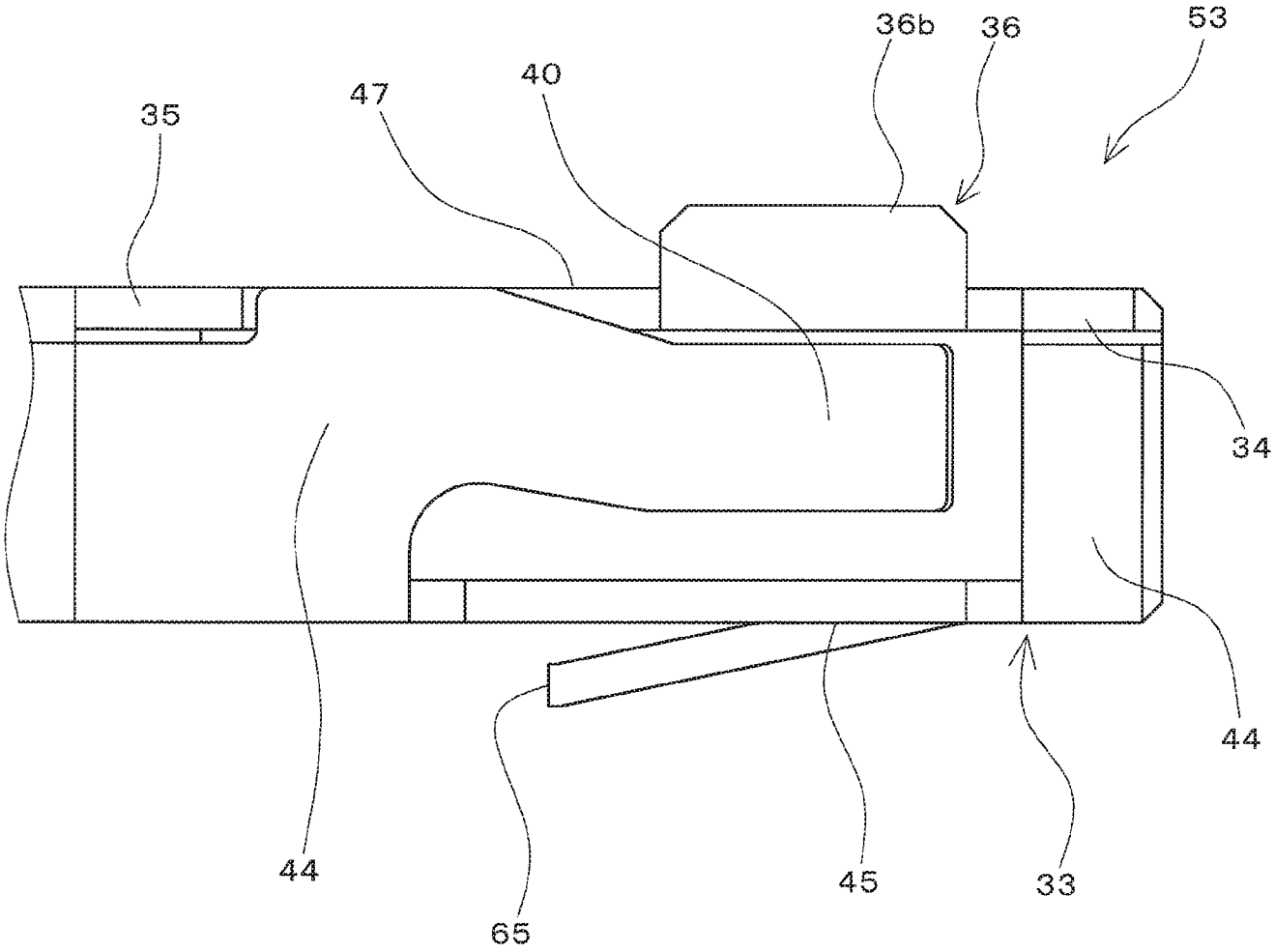
FIG. 24 is a side view of a terminal according to a third variation, and is a partial cutaway view of the terminal according to the third variation.

(3) FIG. 24 is a side view of a terminal 53 according to a third variation, and is a partial cutaway view of the terminal 53 according to the third variation. The terminal 53 according to the third variation has a similar configuration to the terminal 13 of the above embodiment, but is different from the terminal 13 of the above embodiment with respect to the shape of an engaging portion 65. The following describes only configurations of the terminal 53 of the third variation that are different from the terminal 13 of the above embodiment. Also, redundant descriptions of elements having a configuration similar to the above embodiment will be appropriately omitted by assigning the same reference signs in the drawings or citing the descriptions of such elements given in the above embodiment.

The engaging portion 65 of the terminal 53 is provided on the bottom wall portion 45 of the tubular wall portion 33. The engaging portion 65 of the terminal 53 is configured to be able to engage with an engaged portion (not shown) provided inside the housing (not shown) that is to hold the terminal 53 when the tubular wall portion 33 is inserted into the housing in a predetermined insertion orientation. Also, similarly to the engaging portion 37 of the terminal 13, the engaging portion 65 of the terminal 53 projects outward from the bottom wall portion 45 in a direction from the leading end side in the direction of insertion of the tubular wall portion 33 into the housing toward the opposite side in this insertion direction, and also in a direction oblique to the longitudinal direction of the tubular wall portion 33. However, the engaging portion 65 of the terminal 53 projects from a position that is closer to the leading end side of the tubular wall portion 33 than the position of the engaging portion 37 of the terminal 13, and also has a longer projection length. In other words, the projection length of the engaging portion 65 of the terminal 53, which projects outward from the bottom wall portion 45 in a direction from the leading end side in the direction of insertion of the tubular wall portion 33 into the housing toward the opposite side in this insertion direction, and also in a direction oblique to the longitudinal direction of the tubular wall portion 33, is set longer than the projection length of the engaging portion 37 of the terminal 13.

A mode is possible in which the engaging portion has a different shape, as with the terminal 53 of the third variation. Also, the shape of the engaging portion is not limited to the examples of the terminal 13 and the terminal 53, and may be modified in various ways. Also, a connector including the terminal of the above variation is also encompassed in the present invention. Furthermore, an electrical connection apparatus including the terminal of the above variation is also encompassed in the present invention.

Figure 25:
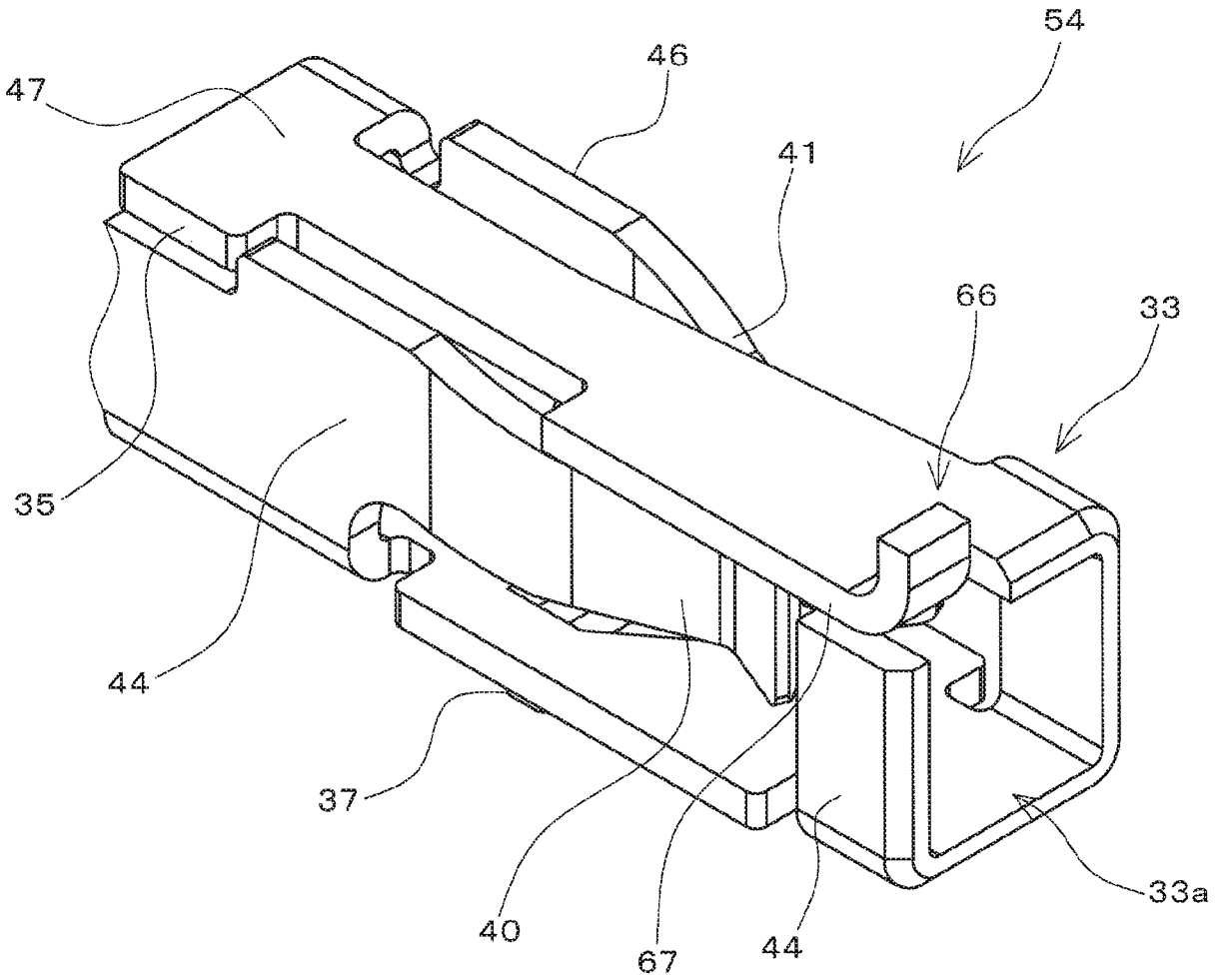
FIG. 25 is a perspective view of a terminal according to a fourth variation, and is a partial cutaway view of the terminal according to the fourth variation.

(4) FIG. 25 is a perspective view of a terminal 54 according to a fourth variation, and is a partial cutaway view of the terminal 54 according to the fourth variation. The terminal 54 according to the fourth variation has a similar configuration to the terminal 13 of the above embodiment, but is different from the terminal 13 of the above embodiment with respect to the configurations of the projection portion 66 and the abutting portion 67. The following describes only configurations of the terminal 54 of the fourth variation that are different from the terminal 13 of the above embodiment. Also, redundant descriptions of elements having a configuration similar to the above embodiment will be appropriately omitted by assigning the same reference signs in the drawings or citing the descriptions of such elements given in the above embodiment.

In the terminal 13, the abutting portion 34 is provided on the end portion of the upper wall portion 47 on the leading end side in the direction of insertion of the tubular wall portion 33 into the housing 14, and the projection portion 36 is provided on the side opposite to the leading end side of the tubular wall portion 33, relative to the abutting portion 34. However, in the terminal 54, the positions of the abutting portion 67 and the projection portion 66 are set opposite to the positions of the abutting portion 34 and the projection portion 36. Specifically, the projection portion 66 of the terminal 54 is provided on the end portion on the leading end side in the direction of insertion of the tubular wall portion 33 into the housing (the housing that is to hold the terminal 54). Also, the abutting portion 67 is provided on the side opposite to the leading end side of the tubular wall portion 33, relative to the projection portion 66.

Also, in the terminal 13, the projection portion 36 is provided on an edge portion of the upper wall portion 47 that extends along the longitudinal direction of the tubular wall portion 33. However, unlike the terminal 13, in the terminal 54, the projection portion 66 protrudes from an edge portion on the terminal insertion opening 33*a* side of the upper wall portion 47 in the shape of a protrusion or a projection. Also, the projection portion 66 is configured to abut against the housing (not shown) that is to hold the terminal 54 when the tubular wall portion 33 is inserted into the housing in an orientation different from a predetermined insertion orientation. Furthermore, by abutting against the housing in this way, the projection portion 66 is configured to restrict insertion of the tubular wall portion 33 toward the back of the housing in an orientation different from a predetermined insertion orientation.

Similarly to the abutting portion 34 of the terminal 13, the abutting portion 67 of the terminal 54 is provided as a portion of an edge portion of the upper wall portion 47. However, the abutting portion 67 is provided integrated with and adjacent to the projection portion 66 without the notch portion 48 of the terminal 13 therebetween, and furthermore is provided on the side opposite to the leading end side of the tubular wall portion 33, relative to the projection portion 66. The abutting portion 67 is a portion of the edge portion of the upper wall portion 47, and is provided as a portion of the edge portion of the upper wall portion 47 that is arranged at a position that opposes an edge portion of the first side wall portion 44 via a gap. Also, the abutting portion 67 is configured to abut against the edge portion of the first side wall portion 44 when the upper wall portion 47 bends toward the inside of the tubular wall portion 33.

A mode is possible in which the projection portion 66 is provided on an edge portion on the terminal insertion opening 33*a* side of the upper wall portion 47, as with the terminal 54 of the fourth variation. Also, a connector including the terminal of the above variation is also encompassed in the present invention. Furthermore, an electrical connection apparatus including the terminal of the above variation is also encompassed in the present invention.

Figure 26:
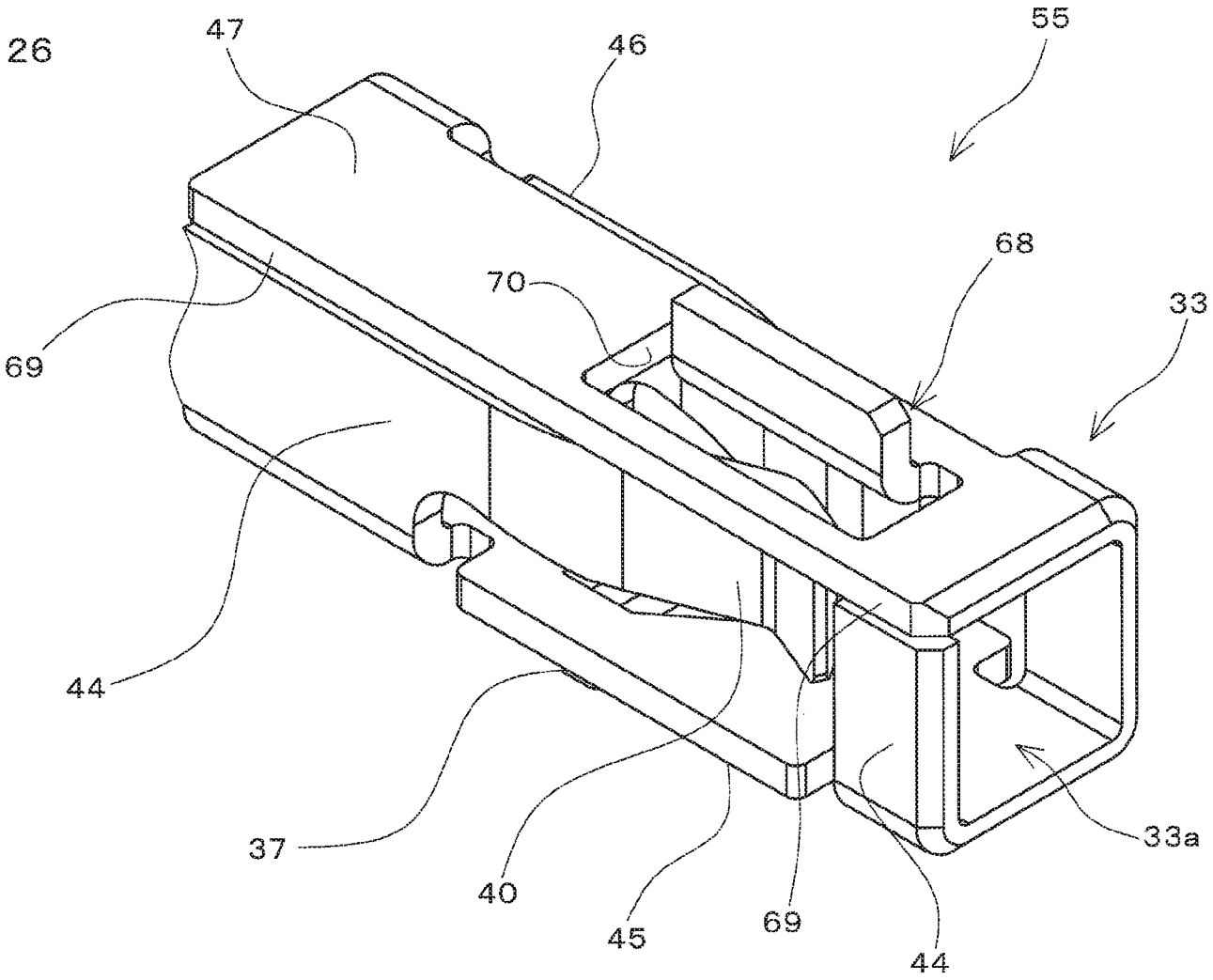
FIG. 26 is a perspective view of a terminal according to a fifth variation, and is a partial cutaway view of the terminal according to the fifth variation.

(5) FIG. 26 is a perspective view of a terminal 55 according to a fifth variation, and is a partial cutaway view of the terminal 55 according to the fifth variation. The terminal 55 according to the fifth variation has a similar configuration to the terminal 13 of the above embodiment, but is different from the terminal 13 of the above embodiment with respect to the configurations of the projection portion 68 and the abutting portion 69. The following describes only configurations of the terminal 55 of the fifth variation that are different from the terminal 13 of the above embodiment. Also, redundant descriptions of elements having a configuration similar to the above embodiment will be appropriately omitted by assigning the same reference signs in the drawings or citing the descriptions of such elements given in the above embodiment.

In the terminal 13, the projection portion 36 is provided on an edge portion of the upper wall portion 47. However, in the terminal 55, the projection portion 68 is not provided on an edge portion of the upper wall portion 47, and is instead formed by cutting a portion of the upper wall portion 47 and bending it toward the outside of the tubular wall portion 33. More specifically, the upper wall portion 47 of the terminal 55 is provide with a cut portion 70 in the central portion in the width direction of the upper wall portion 47. Note that the width direction of the upper wall portion 47 is the same direction as the width direction of the tubular wall portion 33. Part of the portion that was cut from the upper wall portion 47 when forming the cut portion 70 is raised up so as to project toward the outside of the tubular wall portion 33, thus forming the projection portion 68.

The projection portion 68 of the terminal 55 is provided by a portion in the central portion in the width direction of the upper wall portion 47 being cut and raised so as to project in the shape of a protrusion or a projection. Furthermore, the projection portion 68 is configured to abut against the housing (not shown) that is to hold the terminal 55 when the tubular wall portion 33 is inserted into the housing in an orientation different from a predetermined insertion orientation. By abutting against the housing in this way, the projection portion 68 is configured to restrict insertion of the tubular wall portion 33 toward the back of the housing in an orientation different from a predetermined insertion orientation.

Similarly to the abutting portion 34 of the terminal 13, the abutting portion 69 of the terminal 55 is provided as a portion of an edge portion of the upper wall portion 47. However, the abutting portion 69 is provided as a portion of the edge portion of the upper wall portion 47 that extends a longer length along the longitudinal direction of the tubular wall portion 33, and is provided so as to be capable of abutting against the edge portion of the first side wall portion 44 at multiple locations. For this reason, the abutting portion 69 is provided in a manner of opposing the edge portion of the first side wall portion 44 at multiple locations via gaps. Also, the abutting portion 69 is configured to abut against the edge portion of the first side wall portion 44 at multiple locations when the upper wall portion 47 bends toward the inside of the tubular wall portion 33.

A mode is possible in which the projection portion 68 is formed by cutting and raising a portion of the upper wall portion 47 so as to project in the shape of a protrusion or a projection, and the abutting portion 69 abuts against the edge portion of the first side wall portion 44 at multiple locations, as with the terminal 55 of the fifth variation. Also, a connector including the terminal of the above variation is also encompassed in the present invention. Furthermore, an electrical connection apparatus including the terminal of the above variation is also encompassed in the present invention.

Figure 27:
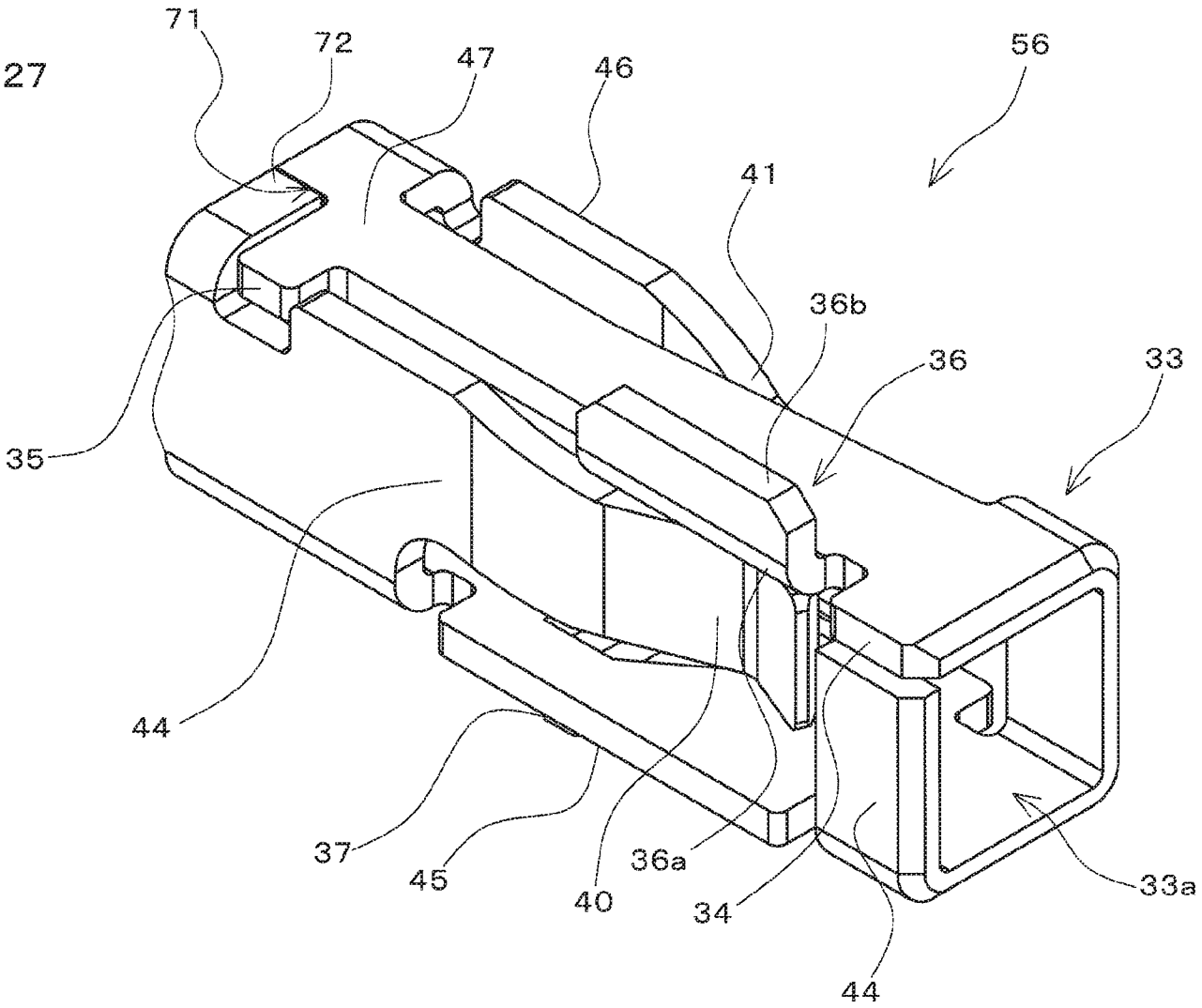
FIG. 27 is a perspective view of a terminal according to a sixth variation, and is a partial cutaway view of the terminal according to the sixth variation.

(6) FIG. 27 is a perspective view of a terminal 56 according to a sixth variation, and is a partial cutaway view of the terminal 56 according to the sixth variation. The terminal 56 of the sixth variation has a similar configuration to the terminal 13 of the above embodiment, but is different from the terminal 13 of the above embodiment in that fitting portions (71, 72) are provided on the upper wall portion 47 and the first side wall portion 44. The following describes only configurations of the terminal 56 of the sixth variation that are different from the terminal 13 of the above embodiment. Also, redundant descriptions of elements having a configuration similar to the above embodiment will be appropriately omitted by assigning the same reference signs in the drawings or citing the descriptions of such elements given in the above embodiment.

The fitting portion 71 is provided as a portion of the upper wall portion 47 that is recessed along the width direction of the upper wall portion 47 in the shape of a groove or a slit. Note that the width direction of the upper wall portion 47 is the same direction as the width direction of the tubular wall portion 33. On the other hand, the fitting portion 72 is provided as a portion that projects and extends from an edge portion of the first side wall portion 44 in the shape of a cantilevered claw. The fitting portion 72 is shaped so as to fit into the fitting portion 71. Also, the portion in which the fitting portion 72 is fitted into the fitting portion 71 constitutes a portion of the rectangular tube-shaped tubular wall portion 33.

A mode is possible in which the tubular wall portion 33 is provided with a portion in which the fitting portion 71, which is recessed in the shape of a groove or a slit, and the fitting portion 72, which projects and extends in the shape of a cantilevered claw, are fitted together, as with the terminal 56 of the sixth variation. Also, a connector including the terminal of the above variation is also encompassed in the present invention. Furthermore, an electrical connection apparatus including the terminal of the above variation is also encompassed in the present invention.

Figure 28:
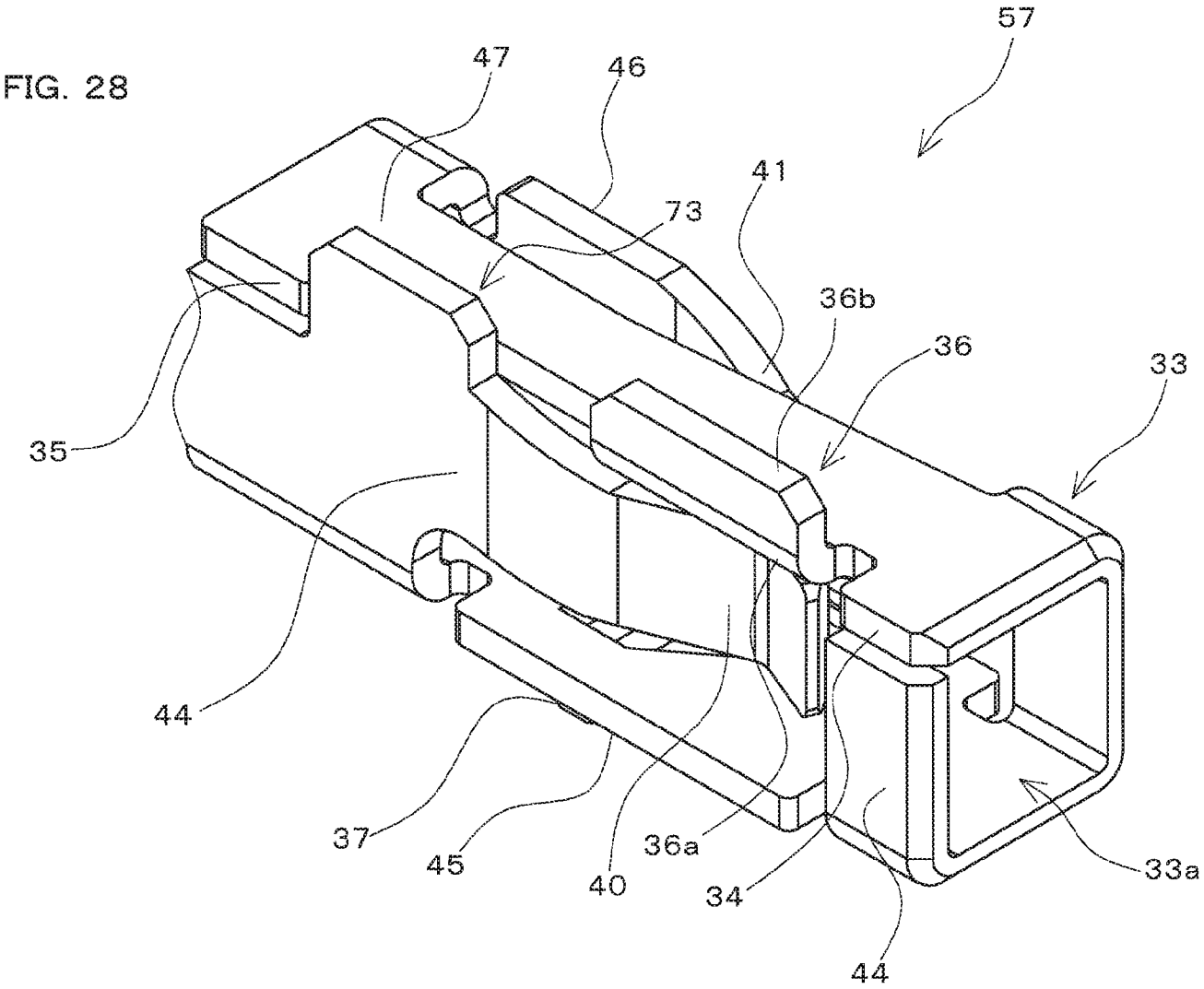
FIG. 28 is a perspective view of a terminal according to a seventh variation, and is a partial cutaway view of the terminal according to the seventh variation.

(7) FIG. 28 is a perspective view of a terminal 57 according to a seventh variation, and is a partial cutaway view of the terminal 57 according to the seventh variation. The terminal 57 according to the seventh variation has a similar configuration to the terminal 13 of the above embodiment, but is different from the terminal 13 of the above embodiment in that a sliding rib 73 is further provided. The following describes only configurations of the terminal 57 of the seventh variation that are different from the terminal 13 of the above embodiment. Also, redundant descriptions of elements having a configuration similar to the above embodiment will be appropriately omitted by assigning the same reference signs in the drawings or citing the descriptions of such elements given in the above embodiment.

The sliding rib 73 is provided on an edge portion of the first side wall portion 44, and protrudes from the edge portion of the first side wall portion 44 in the shape of a protrusion or a projection. Also, the sliding rib 73 is arranged to be aligned along the same straight line as the projection portion 36 in the longitudinal direction of the tubular wall portion 33. The sliding rib 73 is configured to slide and fit into the insertion orientation restriction groove 18 of the housing 14, along with the projection portion 36, when the tubular wall portion 33 is inserted into the terminal insertion hole 16 of the housing 14 in the predetermined insertion orientation. In other words, when the tubular wall portion 33 is inserted into the terminal insertion hole 16 of the housing 14 in the predetermined insertion orientation, first the projection portion 36 slides and fits into the insertion orientation restriction groove 18, and then the sliding rib 73 slides and fits into the insertion orientation restriction groove 18. By further providing the sliding rib 73, the terminal 57 can be inserted more smoothly into the housing 14 in the predetermined insertion orientation.

A mode is possible in which the sliding rib 73 is further provided, as with the terminal 57 of the seventh variation. Also, a connector including the terminal of the above variation is also encompassed in the present invention. Furthermore, an electrical connection apparatus including the terminal of the above variation is also encompassed in the present invention.

(8) The present invention is not limited to the variations described above, and various other modifications may be made. For example, although a mode in which two abutting portions are provided is illustrated in the above embodiment, the present invention is not limited to this. A mode is possible in which the terminal is provided with one abutting portion or three or more.

Also, the above embodiment illustrates a mode of the terminal in which when the tubular wall portion is inserted into the housing in the predetermined insertion orientation, the engaging portion and the engaged portion can engage with each other by the engaged portion abutting against the engaging portion, elastically deforming, and then undergoing elastic recovery, but the present invention is not limited to this. For example, a mode of the terminal is possible in which when the tubular wall portion is inserted into the housing in the predetermined insertion orientation, the engaging portion and the engaged portion can engage with each other by the engaging portion abutting against the engaged portion, elastically deforming, and then undergoing elastic recovery.

Also, the above embodiment illustrates a mode of the terminal in which the pair of contact spring portions are respectively provided as a portion of the first side wall portion and a portion of the second side wall portion and extend in a cantilevered manner, but the present invention is not limited to this. For example, a mode of the terminal is possible in which the pair of contact spring portions are not provided, and the electrical contact portions are provided in a manner of rising from the first side wall portion and the second side wall portion toward the inside of the tubular wall portion in the shape of a protrusion.

Also, the shape of the first housing of the first connector, the shape of the second housing of the second connector, and the shape of the second terminal of the second connector are not limited to the examples illustrated in the above embodiment, and may be modified in various ways. Also, the mode of the substrate to which the second connector is connected is also not limited to the example illustrated in the above embodiment, and may be modified in various ways.

INDUSTRIAL APPLICABILITY

The present invention relates to and is broadly applicable to a terminal for a connector that is used in a state of being inserted into a housing of the connector, as well as a connector that includes this terminal, and an electrical connection apparatus that includes this connector.

What is claimed is:

1. A terminal for a connector that is used in a state of being inserted into a housing of the connector, the terminal comprising:

a tubular wall portion having a first side wall portion, a bottom wall portion that is integrated with the first side wall portion, a second side wall portion that is integrated with the bottom wall portion, and an upper wall portion that is integrated with the second side wall portion;

an abutting portion that is provided as a portion of an edge portion of the upper wall portion, and is configured to abut against an edge portion of the first side wall portion when the upper wall portion bends toward an inside of the tubular wall portion;

a projection portion that protrudes from the upper wall portion in the shape of a protrusion or a projection, and that restricts insertion of the tubular wall portion toward a back of the housing by abutting against the housing when the tubular wall portion is inserted into the housing in an orientation different from a predetermined insertion orientation; and an engaging portion that is provided on the tubular wall portion and is configured to be able to engage with an engaged portion provided on an inner side of the housing when the tubular wall portion is inserted into the housing in the predetermined insertion orientation, wherein the engaging portion and the engaged portion are configured to be able to engage with each other by one of the engaging portion and the engaged portion abutting against the other one, elastically deforming, and then undergoing elastic recovery when the tubular wall portion is inserted into the housing in the predetermined insertion orientation, and the engaging portion is provided on the tubular wall portion at a position that is shifted from or separated from the projection portion in a longitudinal direction that is a direction in which the tubular wall portion extends in a tube shape.

2. The terminal according to claim 1, wherein the projection portion is provided on the tubular wall portion at a position on a leading end side relative to the engaging portion in an insertion direction that is a direction in which the tubular wall portion is inserted into the housing in parallel with the longitudinal direction, and the engaging portion is provided on the tubular wall portion at a position that is shifted from or separated from the projection portion in a direction opposite to the insertion direction.

3. The terminal according to claim 1, wherein the projection portion has a bent portion that is integrated with a portion of the edge portion of the upper wall portion and is provided as a portion that extends while bending relative to the upper wall portion, and a projecting end portion that is provided as a portion projecting and extending from the bent portion in a cantilevered manner.

4. The terminal according to claim 1, further comprising:

electrical contact portions that are provided inside the tubular wall portion; and a pair of contact spring portions that are respectively provided as a portion of the first side wall portion and a portion of the second side wall portion, and that are provided as plate spring-shaped portions that extend in a cantilevered manner, wherein the electrical contact portions are respectively provided on leading end sides of the pair of contact spring portions that extend in a cantilevered manner.

5. The terminal according to claim 4, wherein the contact spring portions are each arranged inward in a width direction of the tubular wall portion relative to an edge portion of the upper wall portion.

6. The terminal according to claim 1, wherein a plurality of the abutting portions are provided, and the plurality of abutting portions are provided on the upper wall portion at positions that are separated from each other in the longitudinal direction.

7. A connector comprising a plurality of the terminals according to claim 1, and further comprising:

a housing configured to hold the plurality of terminals, wherein a plurality of the engaged portions are provided on an inner side of the housing, and the engaged portions are configured to be capable of being engaged with the engaging portions of the terminals.

8. An electrical connection apparatus comprising the connector according to claim 7, further comprising:

a second connector capable of being mated and connected to a first connector configured as the connector, wherein the second connector comprises:

a plurality of second terminals capable of being electrically connected to a plurality of first terminals that are configured as the plurality of terminals in the first connector; and a second housing that is configured to hold the plurality of second terminals, and is configured to be mated to a first housing that is configured as the housing of the first connector, and the second housing is provided with a mating portion that has an opening into which the first housing is to be inserted, and that is mated to the first housing when the first housing is inserted through the opening, and a flat surface that is provided at a position that faces outside through the opening on an inner side of the mating portion, and that extends in a flat manner along a direction perpendicular to a direction in which the first housing is inserted through the opening.

* * * * *